US011391538B2

(12) United States Patent
Cabahug et al.

(10) Patent No.: US 11,391,538 B2
(45) Date of Patent: Jul. 19, 2022

(54) FIREARM WITH ELECTRICAL POWER SOURCE

(71) Applicant: T-Worx Holdings, LLC, Sterling, VA (US)

(72) Inventors: Eric F. Cabahug, Fairfax, VA (US); Benjamin F. Feldman, Sterling, VA (US); Tyler J. Miller, Dickerson, MD (US); Tho N. Nguyen, Ashburn, VA (US)

(73) Assignee: T-Worx Holdings, LLC, Sterling, VA (US)

( * ) Notice: Subject to any disclaimer, the term of this patent is extended or adjusted under 35 U.S.C. 154(b) by 0 days.

(21) Appl. No.: 17/196,882

(22) Filed: Mar. 9, 2021

(65) Prior Publication Data

US 2021/0356230 A1 Nov. 18, 2021

Related U.S. Application Data

(63) Continuation of application No. 16/746,749, filed on Jan. 17, 2020, now Pat. No. 10,976,131.

(51) Int. Cl.

| | |
|---|---|
| ***F41C 27/00*** | (2006.01) |
| ***F41A 11/04*** | (2006.01) |
| ***F41C 23/16*** | (2006.01) |
| ***F41C 23/22*** | (2006.01) |
| ***F41A 3/66*** | (2006.01) |

(52) U.S. Cl.

CPC ..... *F41C 27/00* (2013.01); *F41A 3/66* (2013.01); *F41A 11/04* (2013.01); *F41C 23/16* (2013.01); *F41C 23/22* (2013.01)

(58) Field of Classification Search

USPC ..... 42/85

See application file for complete search history.

(56) References Cited

U.S. PATENT DOCUMENTS

| | | | | |
|---|---|---|---|---|
| 2,134,406 | A | 10/1938 | Jacobs | |
| 5,388,364 | A | 2/1995 | Paldino | |
| 7,627,975 | B1 * | 12/2009 | Hines | F41G 11/003 42/84 |
| 7,975,419 | B2 * | 7/2011 | Darian | F41C 27/00 42/84 |
| 8,215,048 | B2 * | 7/2012 | Summers | F41A 17/063 42/84 |

(Continued)

FOREIGN PATENT DOCUMENTS

WO 2013066472 A2 5/2013

OTHER PUBLICATIONS

PCT International Searching Authority; International Search Report and Written Opinion for PCT/US2020/014106; dated May 7, 2020, 10 pages.

*Primary Examiner* — Reginald S Tillman, Jr.

(74) *Attorney, Agent, or Firm* — Merchant & Gould P.C.

(57) ABSTRACT

A firearm includes a lower receiver storing an electrical power source and an upper receiver attached to the lower receiver. A pivot pin device provides a mechanical pivot point between the upper and lower receivers and a transfer of electrical power from the electrical power source in the lower receiver to at least one accessory rail attached to the upper receiver. The at least one accessory rail has electrical contacts that engage corresponding contacts on an electronic accessory device to supply the electrical power to the electronic accessory device.

20 Claims, 28 Drawing Sheets

(56) References Cited

U.S. PATENT DOCUMENTS

| | | | | |
|---|---|---|---|---|
| 9,897,411 | B2 | 2/2018 | Compton et al. | |
| 2010/0275489 | A1 | 11/2010 | Cabahug et al. | |
| 2012/0192476 | A1 | 8/2012 | Compton et al. | |
| 2013/0047482 | A1* | 2/2013 | Mulfinger ..... | H01R 13/24 42/84 |
| 2013/0194769 | A1 | 8/2013 | Belack | |
| 2016/0298916 | A1 | 10/2016 | Sturm | |
| 2018/0328698 | A1 | 11/2018 | Miller et al. | |

* cited by examiner

FIREARM WITH ELECTRICAL POWER SOURCE

CROSS-REFERENCE TO RELATED APPLICATION(S)

This application is a Continuation of U.S. application Ser. No. 16/746,749, filed on Jan. 17, 2020, the disclosure of which is hereby incorporated by reference in its entirety. To the extent appropriate a claim of priority is made to the above-disclosed application.

BACKGROUND

To improve situational awareness, electronic accessory devices such as lights, radios, thermal imaging cameras, range finders, displays, and the like are added to firearms. Each electronic accessory device typically has its own batteries as a power source. The batteries in each electronic accessory device can add a significant amount of weight and bulk to a firearm which can make the firearm difficult to carry and aim.

Another problem is to reliably provide electrical power to the electronic accessory devices while mounted on the firearm in an environmentally hostile environment. Rain, humidity, dirt, corrosion, and extreme temperatures can interfere with the steady supply of electrical power to the electronic accessory devices when mounted on a firearm.

SUMMARY

In general terms, the present disclosure relates to a firearm with an electrical power source. In one possible configuration and by non-limiting example, the firearm includes a pivot pin device providing a mechanical pivot point between an upper receiver and a lower receiver, and further providing a transfer of electrical power from the electrical power source in the lower receiver to at least one accessory rail mounted on the upper receiver.

In one aspect, a firearm comprises a lower receiver storing an electrical power source, an upper receiver attached to the lower receiver, and a pivot pin device providing a mechanical pivot point between the upper and lower receivers. The pivot pin device further provides a transfer of electrical power from the electrical power source in the lower receiver to at least one accessory rail attached to the upper receiver. The at least one accessory rail having electrical contacts configured to engage corresponding contacts on an electronic accessory device to supply the electrical power to the electronic accessory device.

In another aspect, a pivot pin device for a firearm comprises a housing defining an interior cavity for routing electrical conductors from a first end of the pivot pin device to a second end of the pivot pin device, the housing including: a cylindrical portion terminating at the first end and being configured to provide a mechanical pivot point between upper and lower receivers of a firearm; and a lateral portion extending substantially orthogonal from the cylindrical portion and terminating at the second end; first and second electrical contacts positioned at the first end, the first and second electrical contacts axially spaced apart from one another and each having an exterior portion configured to engage a respective coil contact inside a receptacle in the lower receiver, and each having an interior portion engaging a respective electrical conductor; and a plug portion positioned at the second end, the plug portion being configured for insertion inside a ruggedized connector port in the upper receiver to mate the electrical conductors with corresponding conductors inside the ruggedized connector port for transferring electrical power from the lower receiver to the upper receiver.

In another aspect, an electrical system for a firearm comprises an electrical power source; a socket drawing electrical power from the electrical power source; lower conductors carrying the electrical power from the socket to a receptacle, the receptacle configured for being incorporated into a lower receiver of a firearm; a pivot pin device transferring the electrical power from the receptacle to a ruggedized connector port, the ruggedized connector port configured for being incorporated into an upper receiver of a firearm, the pivot pin device being configured to provide a mechanical pivot point between the upper and lower receivers of the firearm; upper conductors carrying the electrical power from the ruggedized connector port to a conductive bus, the conductive bus configured for attachment to the upper receiver; and at least one accessory rail receiving the electrical power from the conductive bus, the at least one accessory rail configured for attachment to the upper receiver and having electrical contacts configured to engage corresponding contacts on an electronic accessory device to supply the electrical power to the accessory electronic accessory device.

In another aspect, a power coupling for use on an accessory rail comprises: a housing defining an interior space; a conductive bus housed inside the interior space, the conductive bus configured to transfer electrical power around a barrel of a firearm; receptacles electrically connected to the conductive bus, each receptacle configured to receive an end of a conductive strip; and sealing glands sealing a connection between each receptacle and conductive strip.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the examples disclosed herein are based.

DESCRIPTION OF THE FIGURES

The following drawing figures, which form a part of this application, are illustrative of described technology and are not meant to limit the scope of the disclosure in any manner.

DETAILED DESCRIPTION

Figure 1:
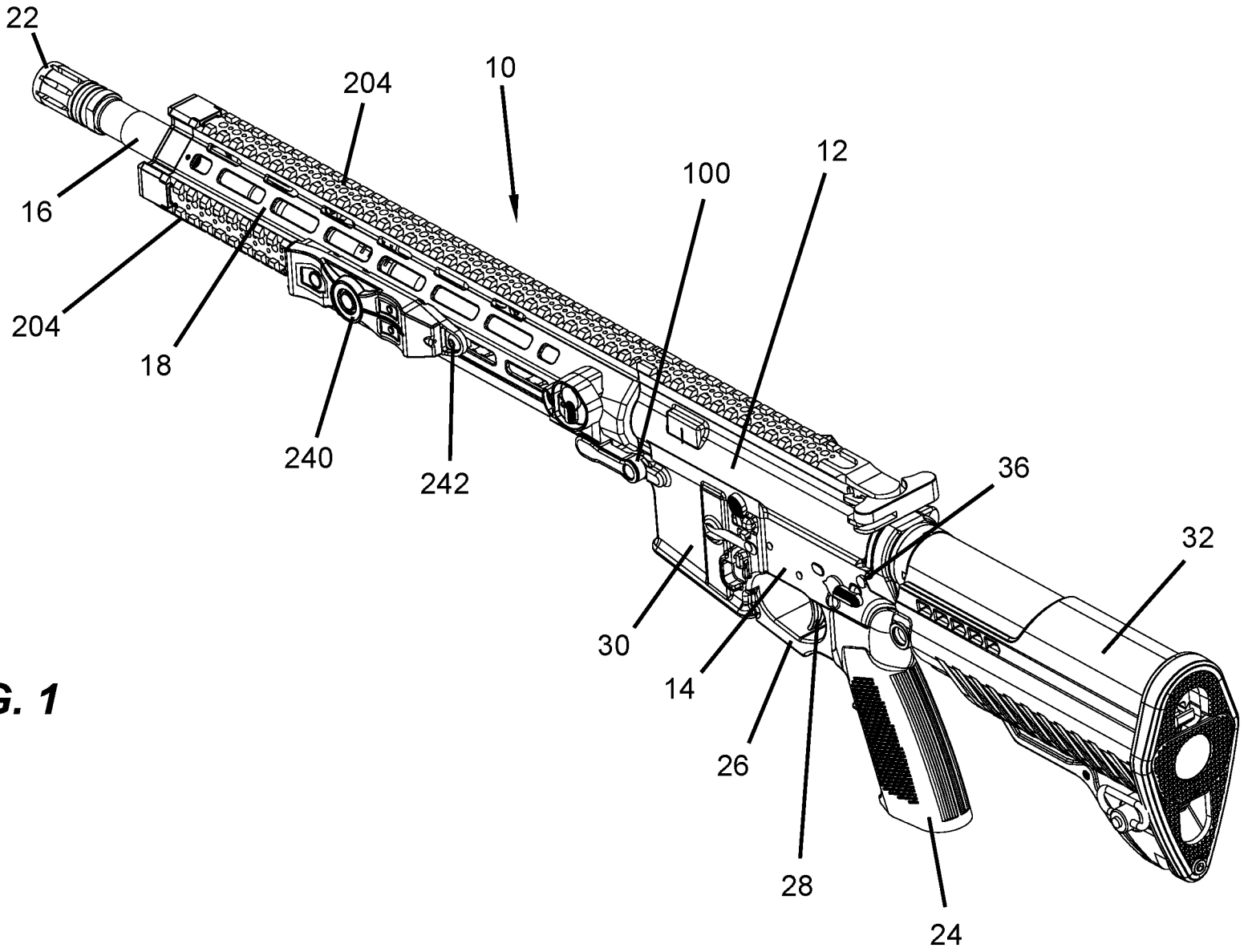
FIG. 1 is an isometric view of a first side of a firearm with an integrated power source, the firearm being shown in a closed position.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
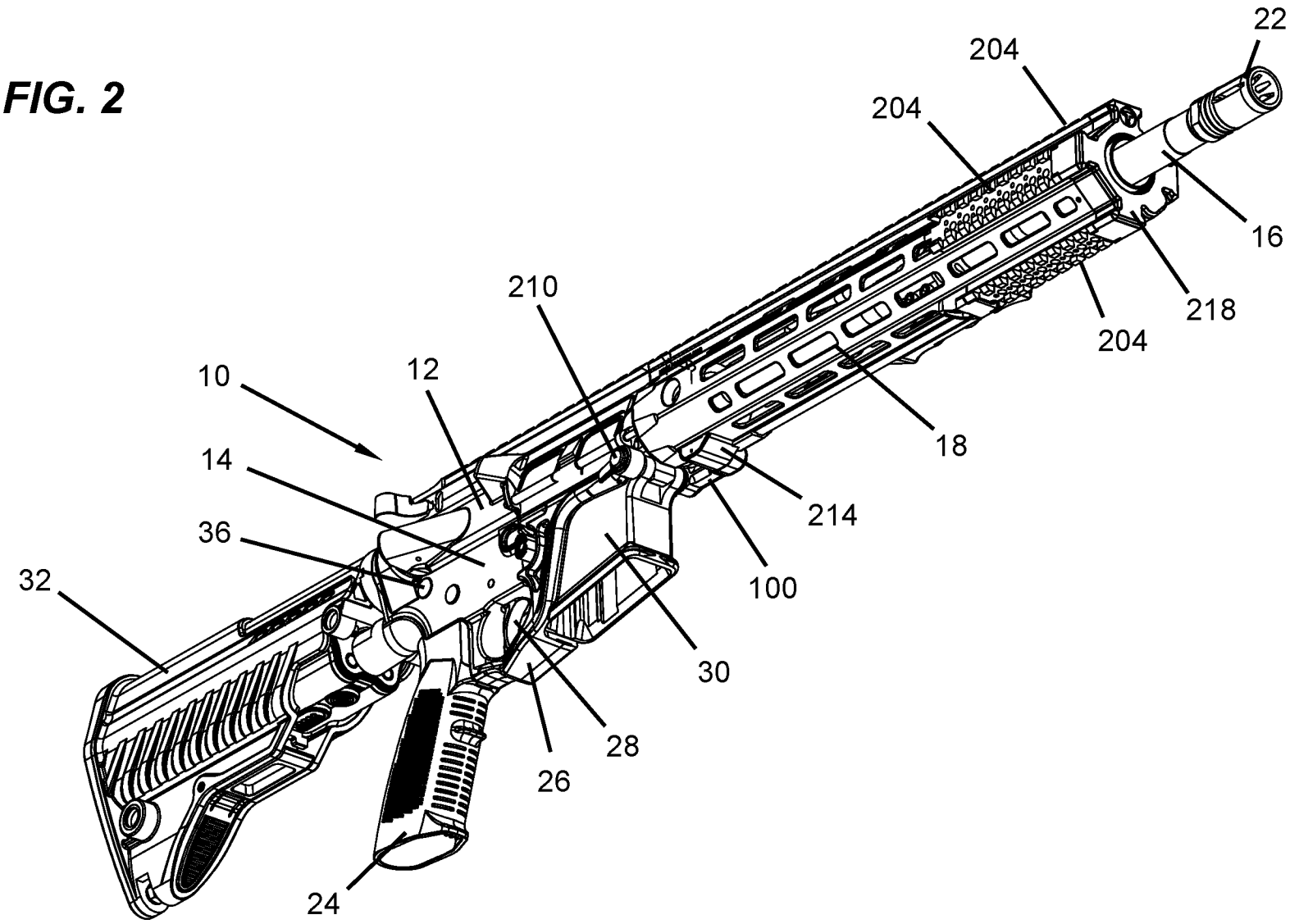
FIG. 2 is an isometric view of a second side of the firearm shown in the closed position.

FIGS. 1 and 2 are isometric views of first and second sides, respectively, of a firearm 10. In FIGS. 1 and 2, the firearm 10 is shown in a closed position. When in the closed position, the firearm 10 is operational such that the firearm 10 is able to fire a round of ammunition. While a military-style firearm is shown and described herein, the various embodiments, concepts, and features that are described herein can be incorporated into other types of firearms including handguns, bolt action rifles, shotguns, fixed-mount machine guns, as well as into other types of weapons such as bows and non-weapons such as air-soft (e.g., paint ball) systems.

The firearm 10 includes an upper receiver 12 attached to a lower receiver 14. The upper receiver 12 includes a barrel 16, a handguard 18 that partially surrounds the barrel 16, at least one accessory rail 204, and a muzzle 22. The lower receiver 14 includes a grip 24, a trigger guard 26, a trigger 28, a magazine well 30, and a buttstock 32. Alternative configurations are contemplated such that the upper and lower receivers 12, 14 of the firearm 10 may include additional components not shown in the figures or may not include all components shown in the figures such that some of the components can be optional.

Figure 3:
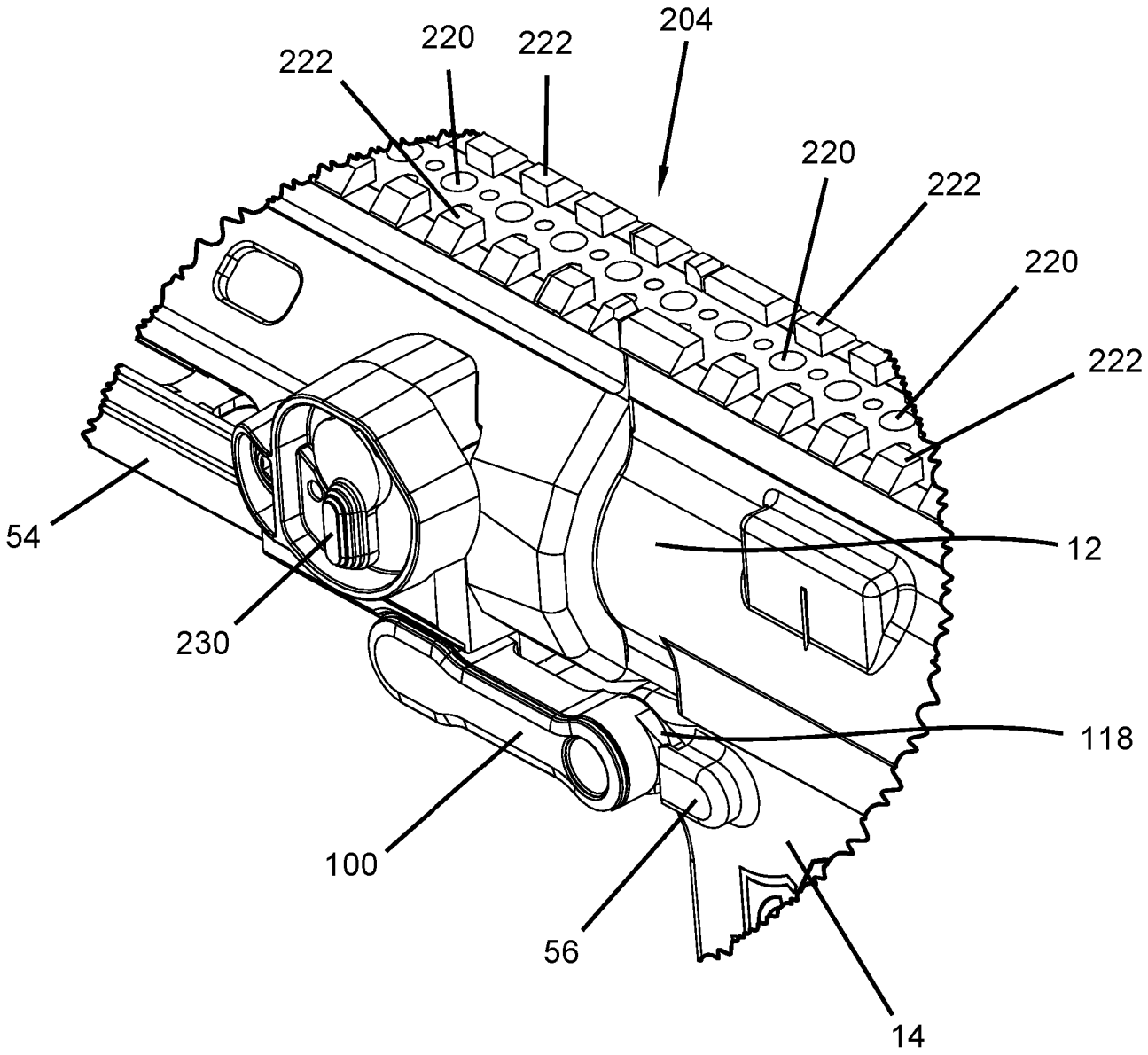
FIG. 3 is a detailed view of FIG. 1.

FIG. 3 is a detailed view of the connection between the upper and lower receivers 12, 14. In FIG. 3, the firearm 10 is shown in the closed position. As will be described in more detail, the lower receiver 14 is at least partially attached to the upper receiver 12 by a pivot pin device 100.

Figure 4:
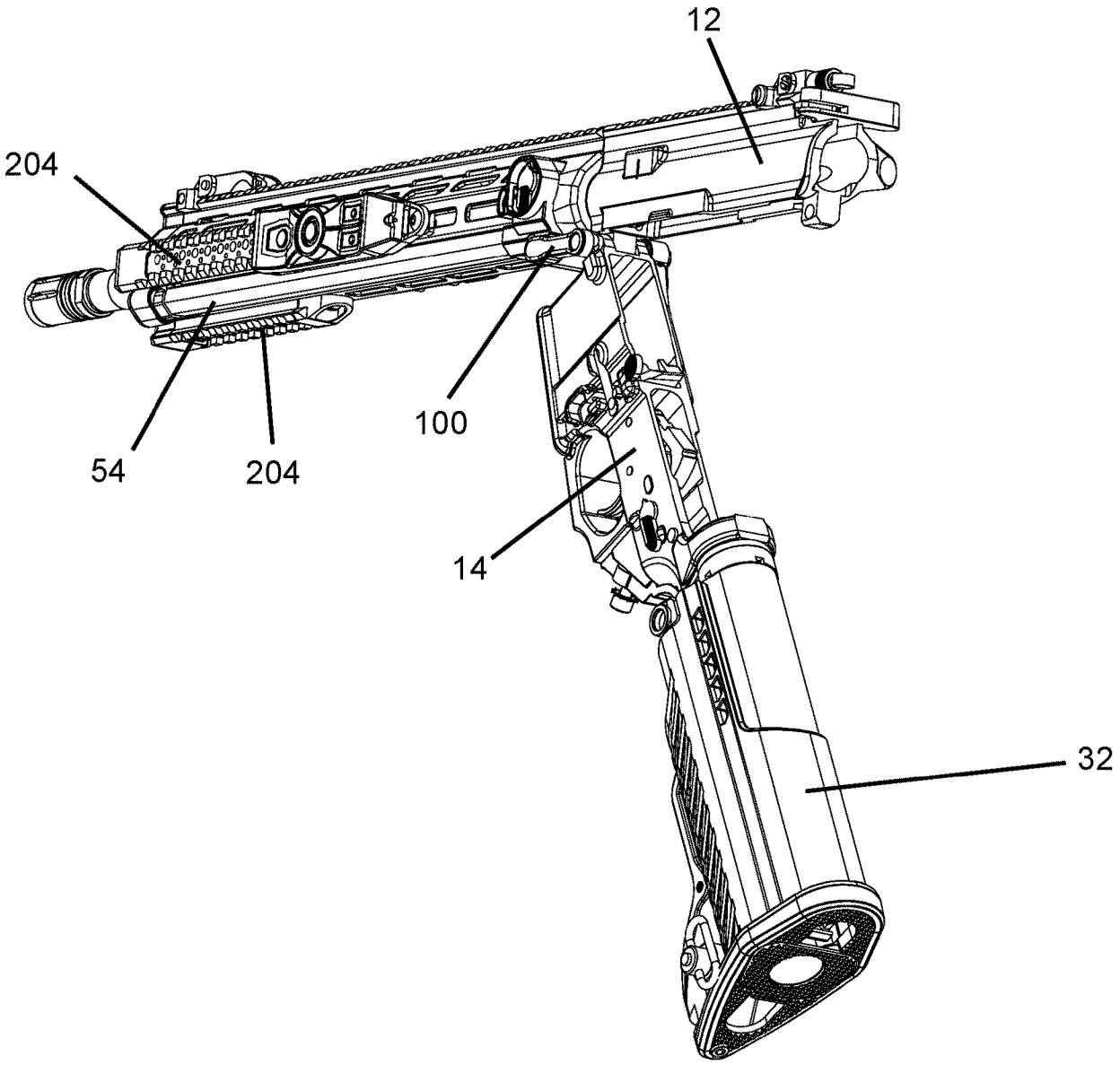
FIG. 4 is an isometric view of the firearm in an open positon.
Figure 5:
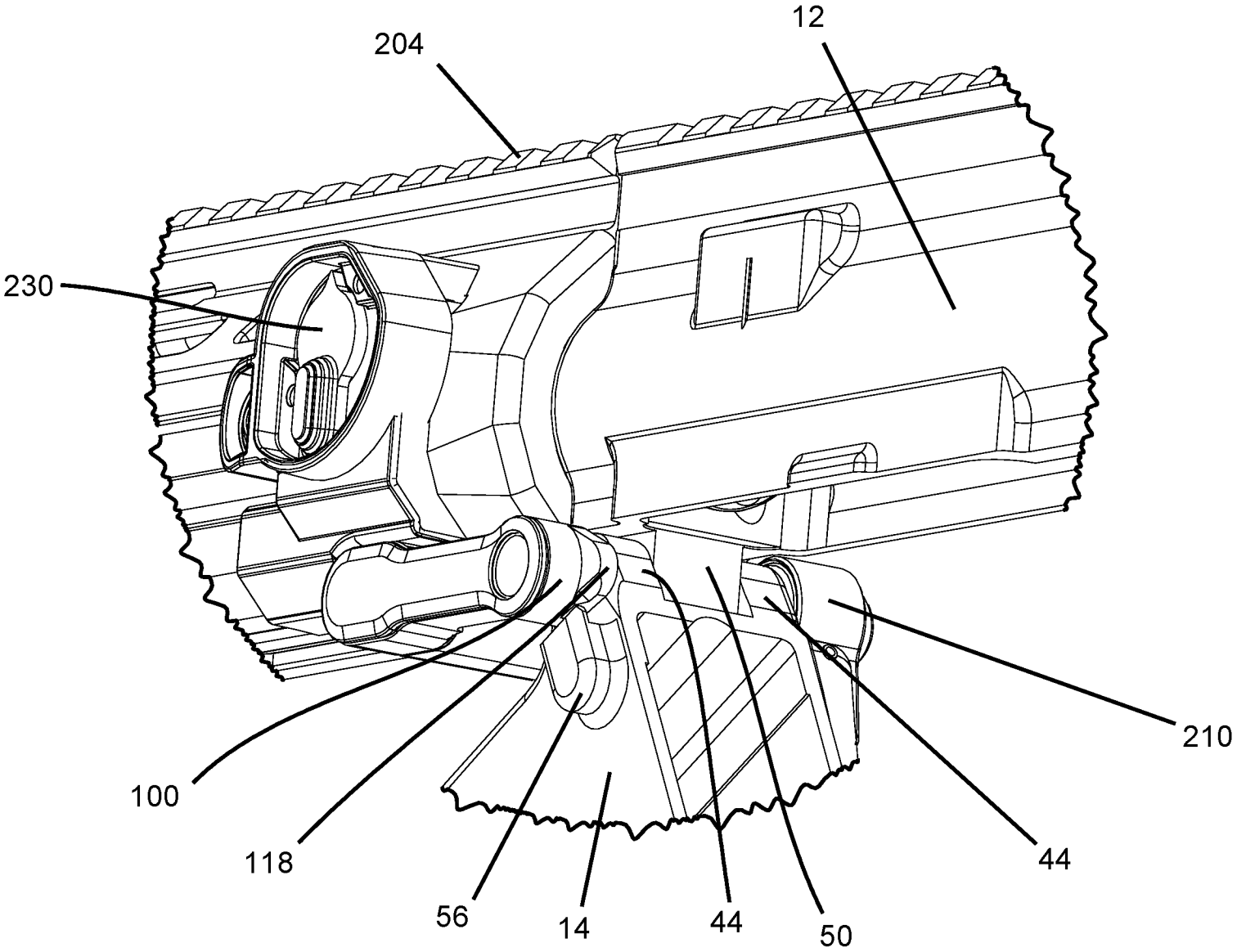
FIG. 5 is a detailed view of FIG. 4.

FIGS. 4 and 5 show the firearm 10 in an open position. When in the open position, the internal components of the firearm 10 such as the trigger mechanism are exposed for cleaning and/or replacement. The upper and lower receivers 12, 14 are pivotable with respect to one another about the pivot pin device 100 when a rear pin 36 (see FIGS. 1, 2, and 8) is removed from the upper and lower receivers 12, 14. Thus, the upper and lower receivers 12, 14 can pivot about the pivot pin device 100 from the closed position (see FIGS. 1-3) to the open position (see FIGS. 4 and 5). The upper and lower receivers 12, 14 are separable from one another when both the pivot pin device 100 and rear pin 36 are removed from the upper and lower receivers 12, 14.

In addition to providing a mechanical pivot point between the upper and lower receivers 12, 14, the pivot pin device 100 provides a transfer of electrical power from an electrical power source 202 (see FIGS. 8 and 9) in the lower receiver 14 to the at least one accessory rail 204 on the upper receiver 12. Additionally, the pivot pin device 100 maintains the electrical power supply from the electrical power source 202 in the lower receiver 14 to the at least one accessory rail 204 on the upper receiver 12 when the upper and lower receivers 12, 14 pivot from the closed position to the open positon and from the open position to the closed position.

Referring now to FIGS. 3 and 5, a lobe 118 extends from a lateral portion of the pivot pin device 100 and engages a tab 56 on the lower receiver 14 to prevent removal of the pivot pin device 100 from the firearm 10 when the upper and lower receivers 12, 14 are in the closed position. For example, when in the closed position shown in FIG. 3, the tab 56 blocks the pivot pin device 100 from being pulled out of the firearm 10.

When the upper and lower receivers 12, 14 are in the open position, the lobe 118 disengages the tab 56 allowing removal of the pivot pin device 100 from the firearm 10. For example, when in the open position shown in FIG. 5, the tab 56 no longer blocks the pivot pin device 100 from being pulled out of the firearm 10. The pivot pin device 100 can be removed from the firearm 10 by pulling a lateral portion 110 (see FIGS. 13-20) of the pivot pin device 100 such that tools are not required to remove the pivot pin device 100 from the firearm 10.

Figure 6:
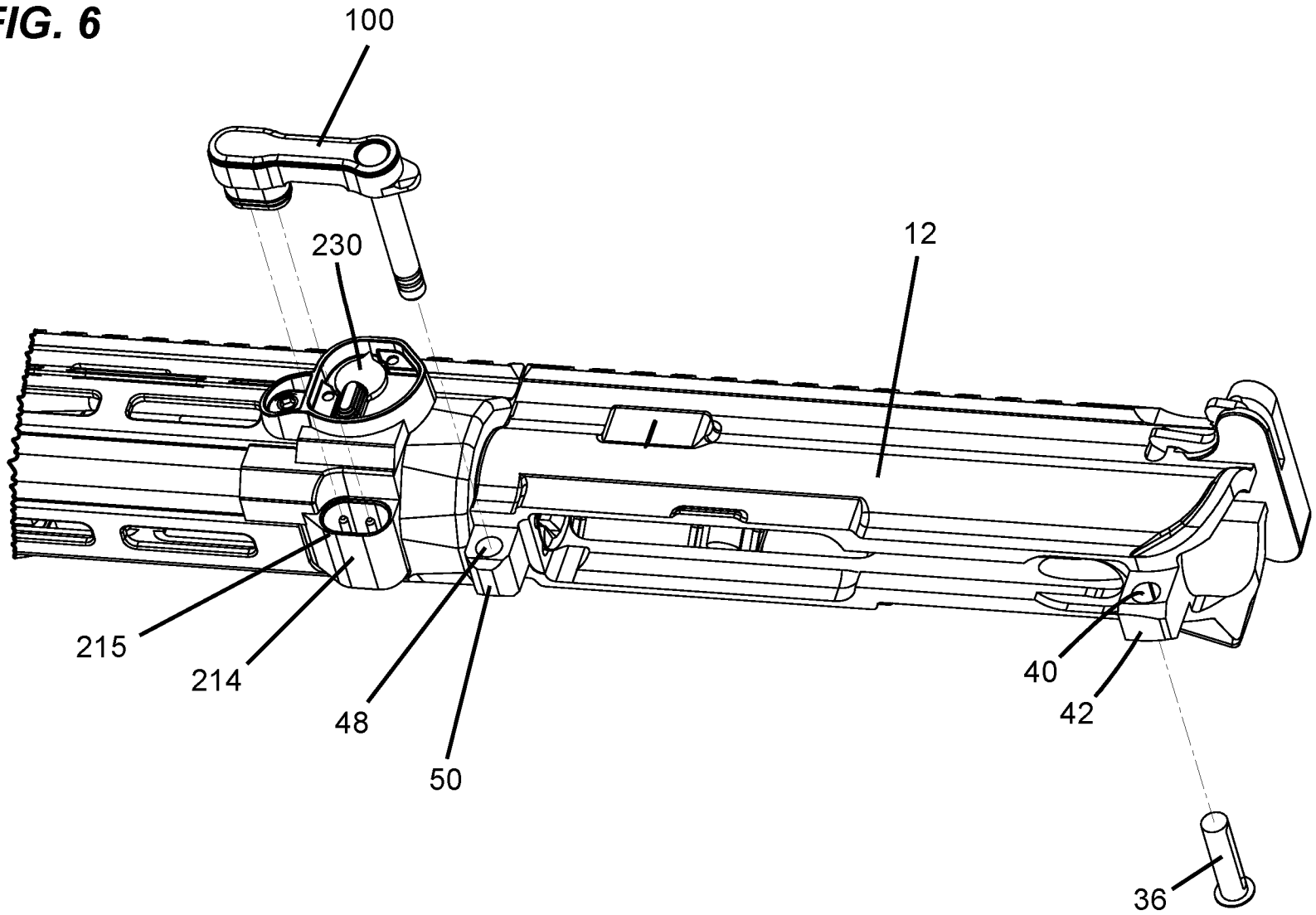
FIG. 6 is an isometric bottom view of the firearm with a lower receiver removed therefrom exposing an interior of an upper receiver of the firearm.
Figure 7:
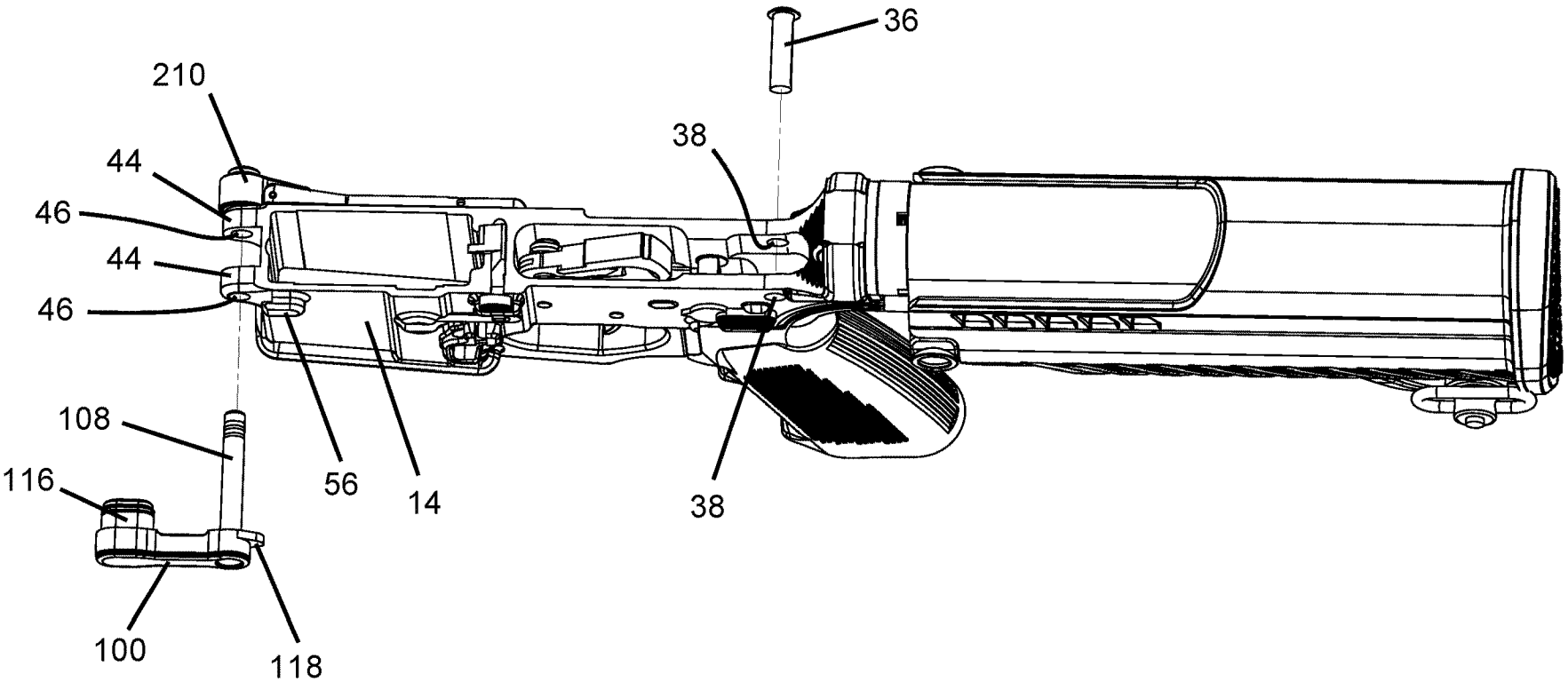
FIG. 7 is an isometric top view of the firearm with the upper receiver removed therefrom exposing an interior of the lower receiver of the firearm.
Figure 8:
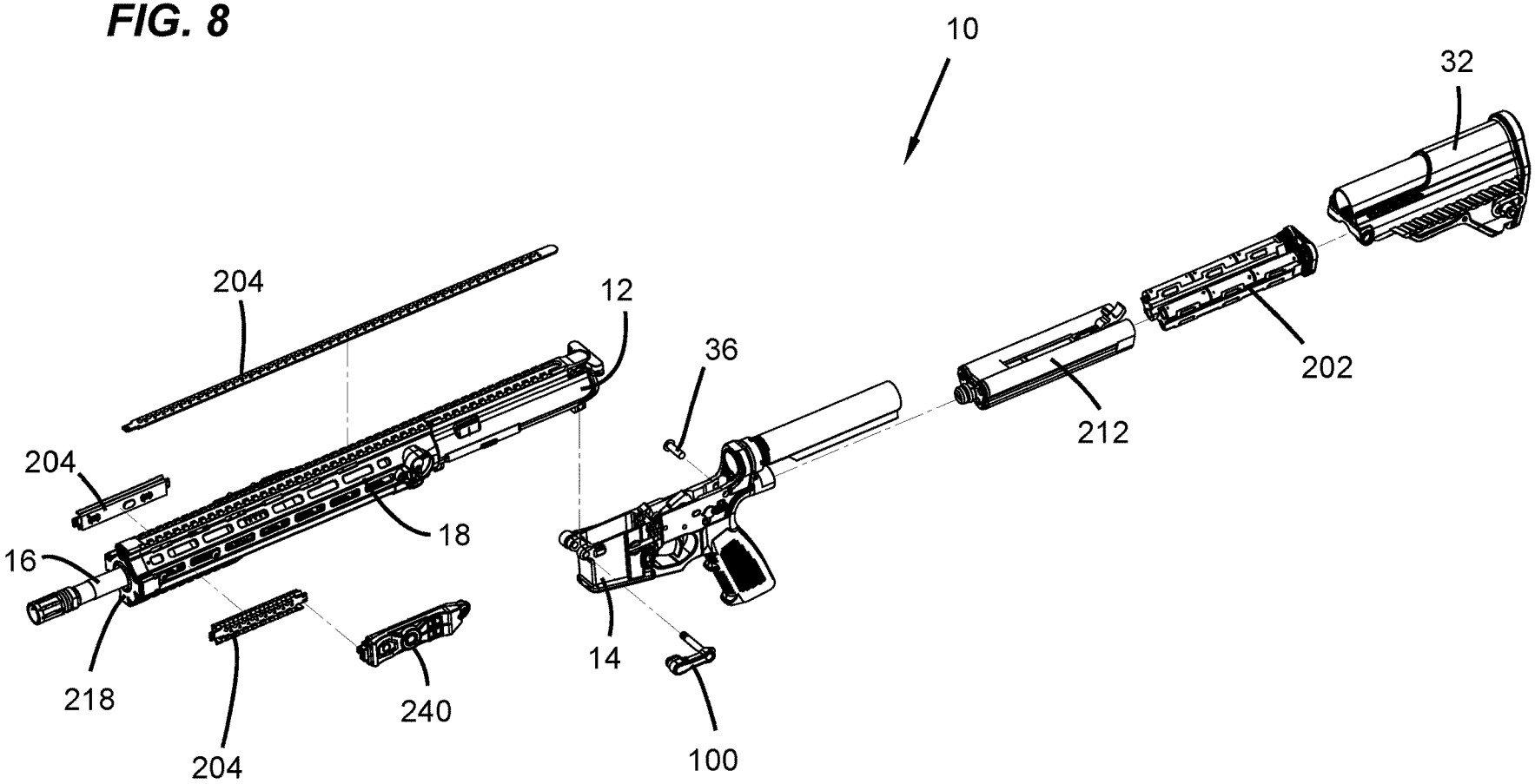
FIG. 8 is an exploded isometric view of the firearm.

FIG. 6 is an isometric bottom view of the upper receiver 12 with the lower receiver 14 removed therefrom. FIG. 7 is an isometric top view of the lower receiver 14 with the upper receiver 12 removed therefrom. FIG. 8 is an exploded view of the firearm 10. Referring now to FIGS. 6-8, the lower receiver 14 includes holes 38 that align with a corresponding hole 40 drilled through a first extension piece 42 of the upper receiver 12. The rear pin 36 is received by the holes 38, 40 to secure the upper and lower receivers 12, 14 together in the closed position.

Still referring to FIGS. 6-8, the lower receiver 14 includes hinges 44 each having a hole 46 that aligns with a corresponding hole 48 drilled through a second extension piece 50 of the upper receiver 12. A first end of the pivot pin device 100 is received by the holes 46, 48 to secure the upper and lower receivers 12, 14 together such that when the rear pin 36 is removed from the firearm 10, the upper and lower receivers 12, 14 can pivot about the pivot pin device 100 from the closed position to the open position and from the open position to the closed position.

Figure 9:
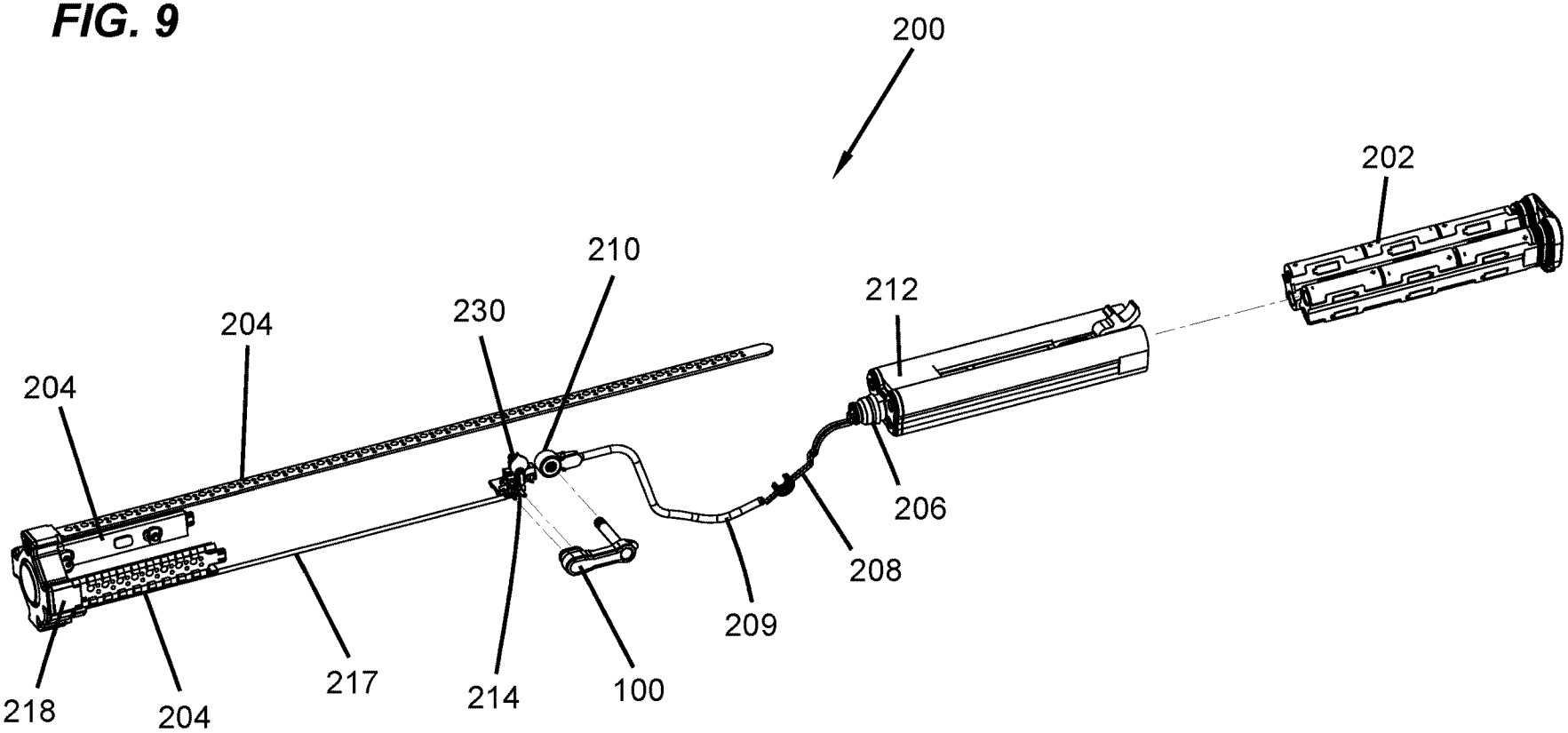
FIG. 9 is an isometric view of the electrical system of the firearm.

FIG. 9 is an isometric view of an electrical system 200 of the firearm 10. The electrical system 200 includes the electrical power source 202 and the at least one accessory rail 204. The electrical power source 202 provides a DC voltage for powering one or more electronic accessory devices that can be mounted to the at least one accessory rail 204. The electrical power source 202 is stored inside a housing 212 held inside the buttstock 32 of the lower receiver 14.

While the drawings show the electrical power source 202 as having a plurality of batteries, the electrical power source 202 may include a single battery or may include more than one battery such as a plurality of batteries. In a preferred embodiment, the electrical power source 202 includes one or more rechargeable batteries. In other embodiments, the electrical power source 202 can include one or more disposable batteries such as AA batteries.

A socket 206 in the lower receiver draws electrical power from the electrical power source 202. Lower conductors 208 carry the electrical power from the socket 206 to a receptacle 210 in the lower receiver. The lower conductors 208 can include a pair of electrical wires that carry the +/−DC voltage generated from the electrical power source 202. The lower conductors 208 can be housed inside a cable jacket 209 to protect them from outside elements.

Figure 10:
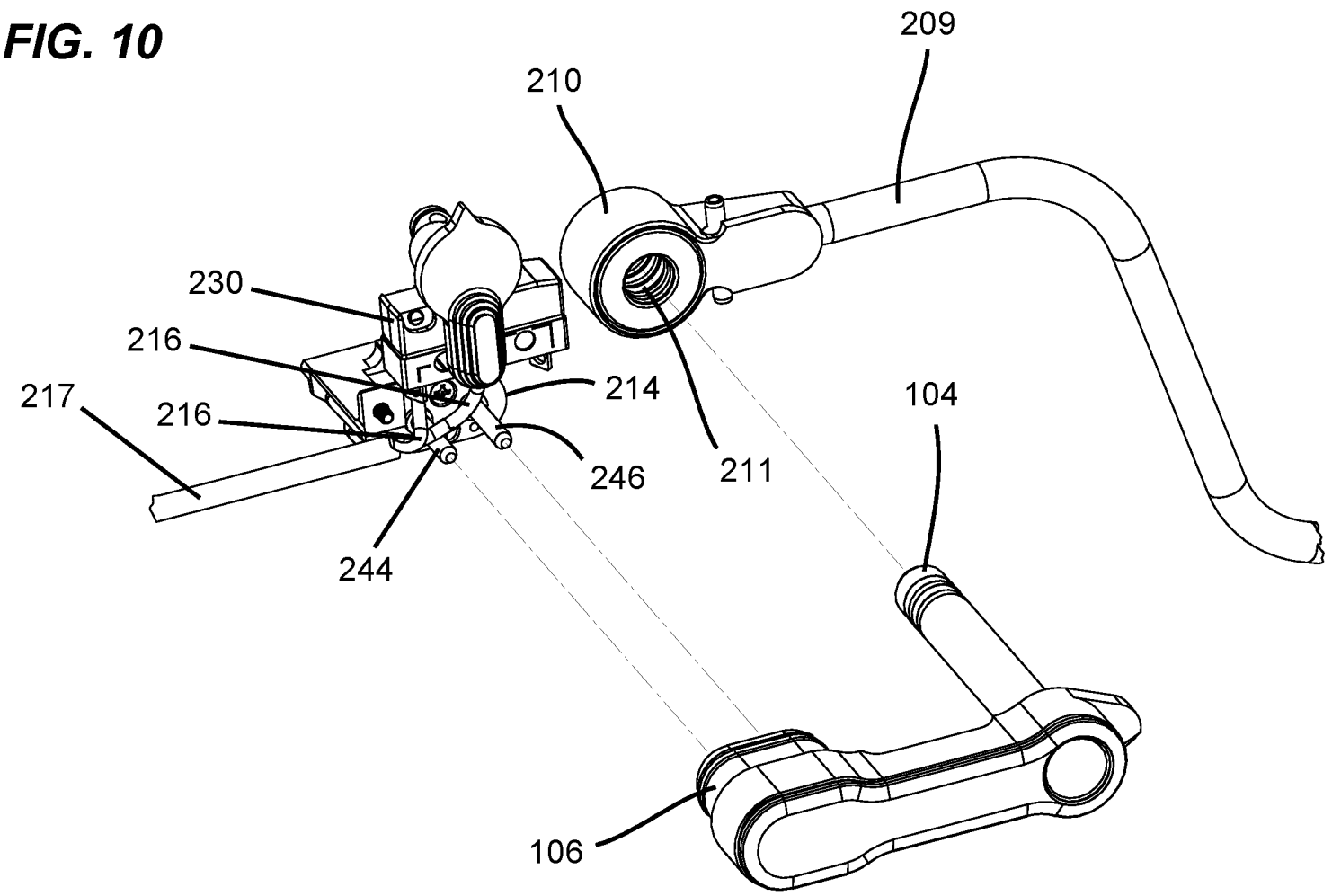
FIG. 10 is a detailed view of the electrical system.

FIG. 10 is a detailed view of the receptacle 210 and pivot pin device 100. The receptacle 210 receives a first end 104 of the pivot pin device 100 to transfer the electrical power to the pivot pin device 100. The receptacle 210 can include one or more seals 211 to prevent dirt, corrosion, water, humidity, and the like from penetrating the interface between the receptacle 210 and the first end 104 of the pivot pin device 100. The seals 211 ensure a reliable flow of electrical power from the lower receiver 14 to the upper receiver 12 of the firearm 10.

Figure 11:
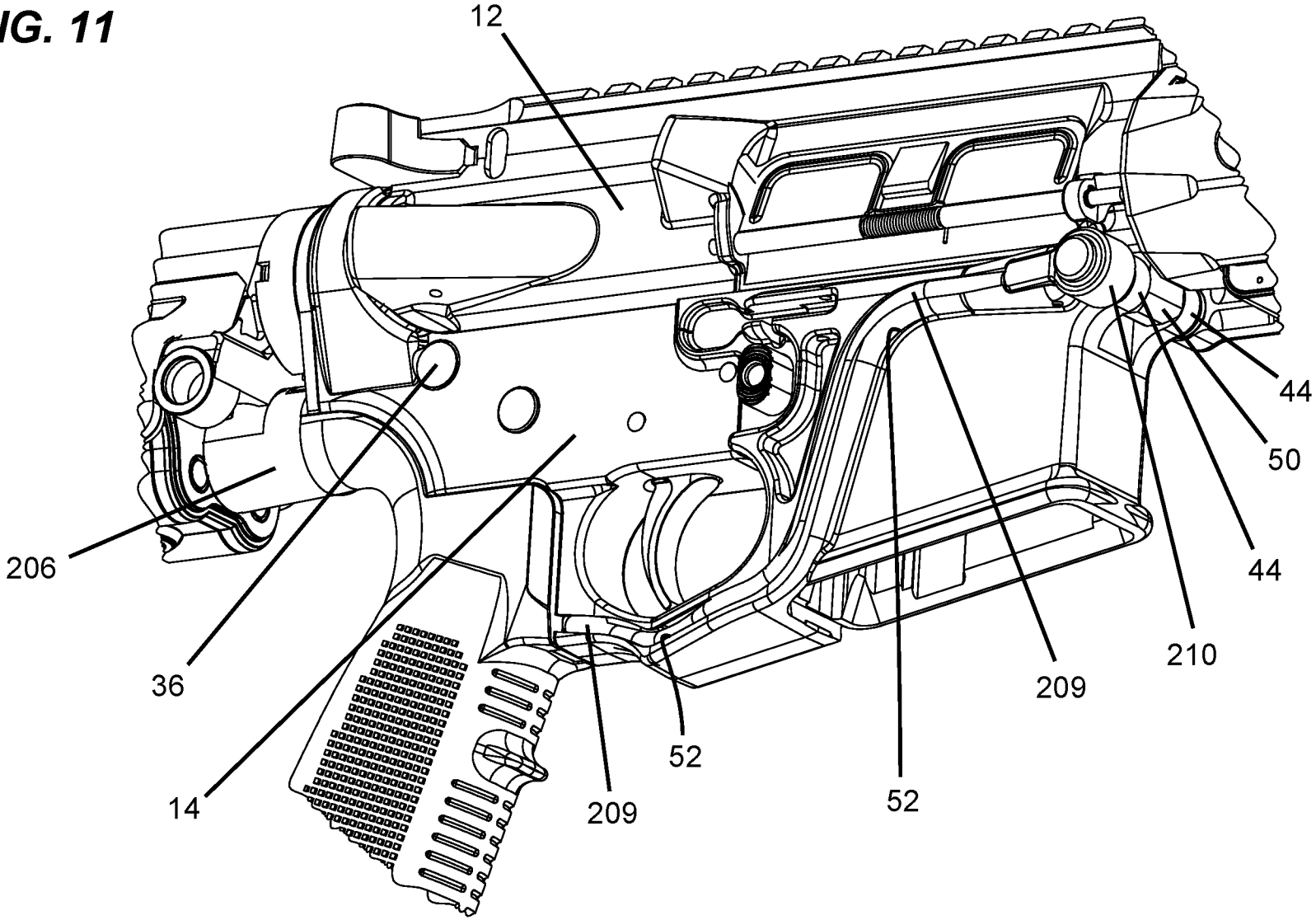
FIG. 11 is a detailed view of the opposite side of the firearm.

FIG. 11 is a detailed view of the opposite side of the firearm 10. As shown in FIG. 11, a channel 52 is embedded in the lower receiver 14 to guide the lower conductors 208 inside the cable jacket 209 from the socket 206 to the receptacle 210. The channel 52 prevents the lower conductors 208 from being snagged by outside elements such as branches, wires, and cables to ensure that the flow of electrical power to the upper receiver 12 is not interrupted.

As shown in FIGS. 6, 9, and 10, a ruggedized connector port 214 in the upper receiver 12 receives a second end of the pivot pin device 100 to receive the electrical power from the electrical power source 202. The ruggedized connector port 214 can include one or more seals to protect the connection with the second end of the pivot pin device 100 such that dirt, corrosion, water, humidity, and the like do not penetrate the connection. The seals between the ruggedized connector port 214 and pivot pin device 100 ensure that there is a reliable flow of electrical power from the lower receiver 14 to the upper receiver 12 of the firearm 10.

Upper conductors 216 carry the electrical power from the ruggedized connector port 214 to a conductive bus assembly 218 that is mounted on the upper receiver 12. The upper conductors 216 can include a pair of electrical wires that carry the +/−DC voltage generated from the electrical power source 202. The upper conductors 216 can be housed inside a cable jacket 217 to protect them from outside elements. As shown in FIGS. 3 and 4, the upper conductors 216 inside the cable jacket 217 are housed inside a sheath 54 that extends along a length of the upper receiver 12. The sheath 54 protects the upper conductors 216 and prevents the upper conductors 216 from being snagged by outside elements such as branches, wires, cables, and the like.

The channel 52 routes the lower conductors 208 along the second side of the firearm 10 while the sheath 54 routes the upper conductors 216 along the first side of the firearm 10. Thus, the pivot pin device 100 not only transfers the electrical power from the lower receiver 14 to the upper receiver 12, but also transfers the electrical power across the firearm 10 from the second side of the firearm 10 to the first side of the firearm 10. Advantageously, running the lower and upper conductors 208, 216 on opposites sides of the firearm 10 improves the weight distribution and balance of the firearm 10 which can make the firearm 10 easier to carry and aim.

Figure 12:
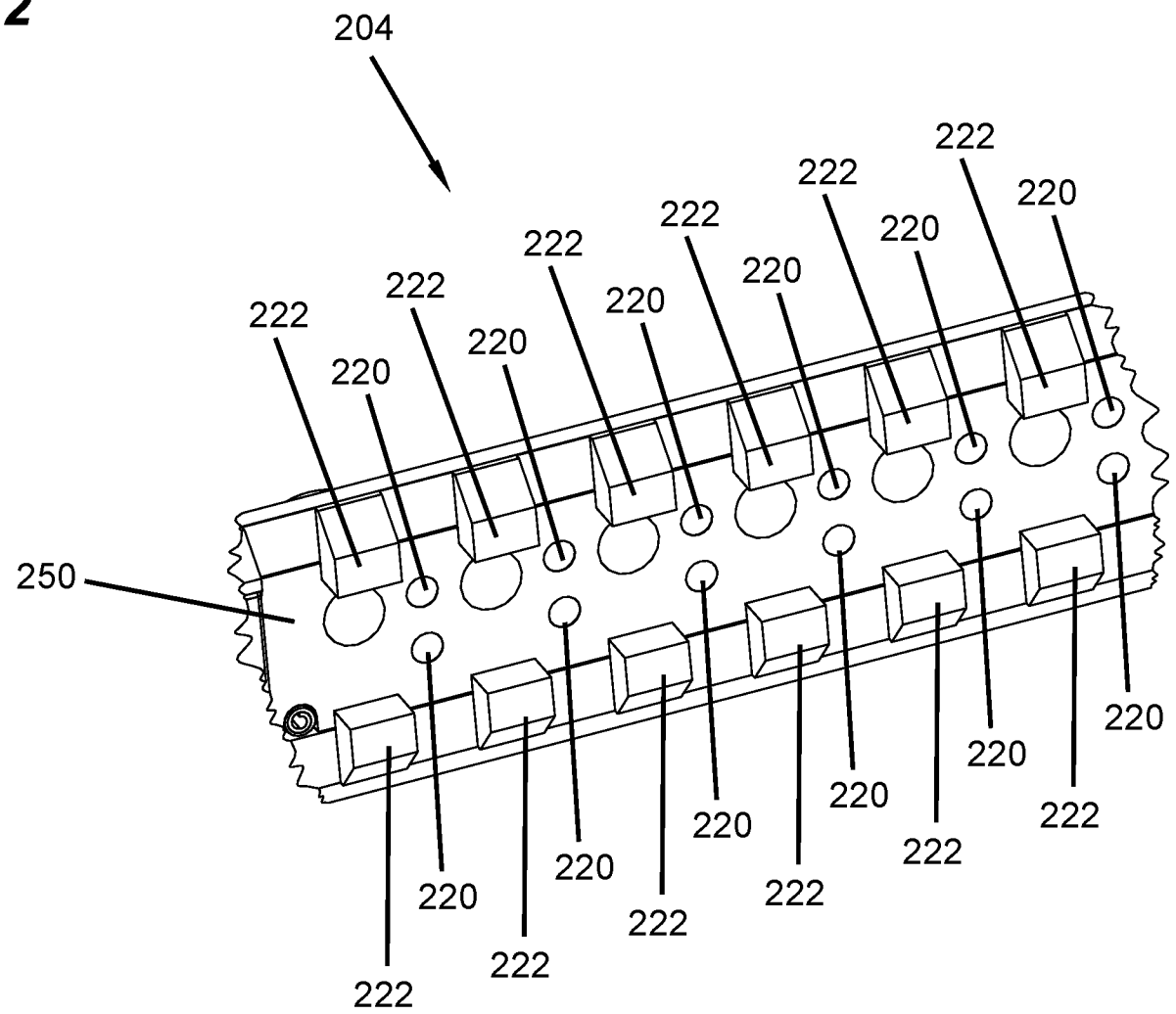
FIG. 12 is another detailed view of the electrical system.
Figure 13:
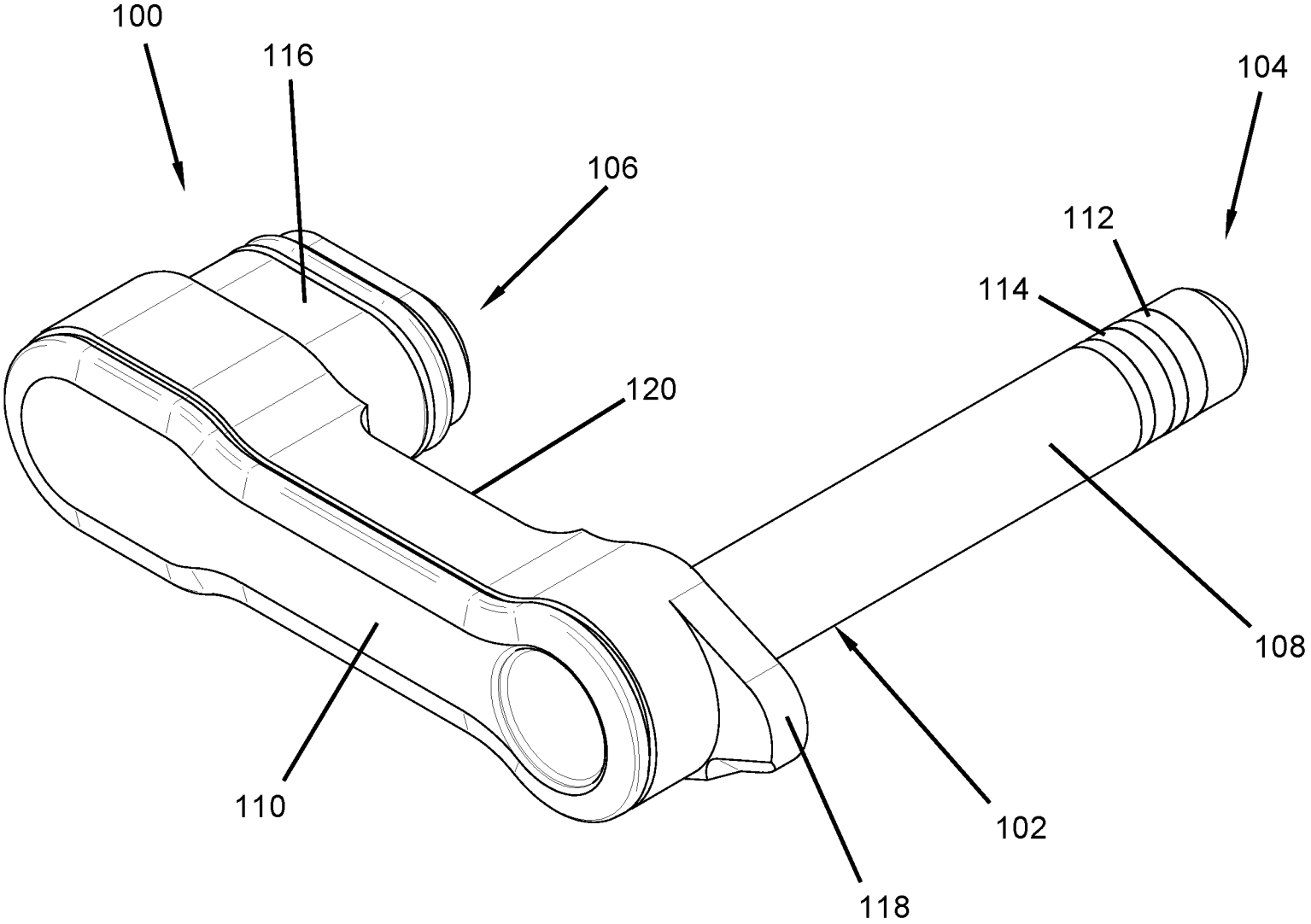
FIG. 13 is a isometric view of a pivot pin device of the firearm.
Figure 14:
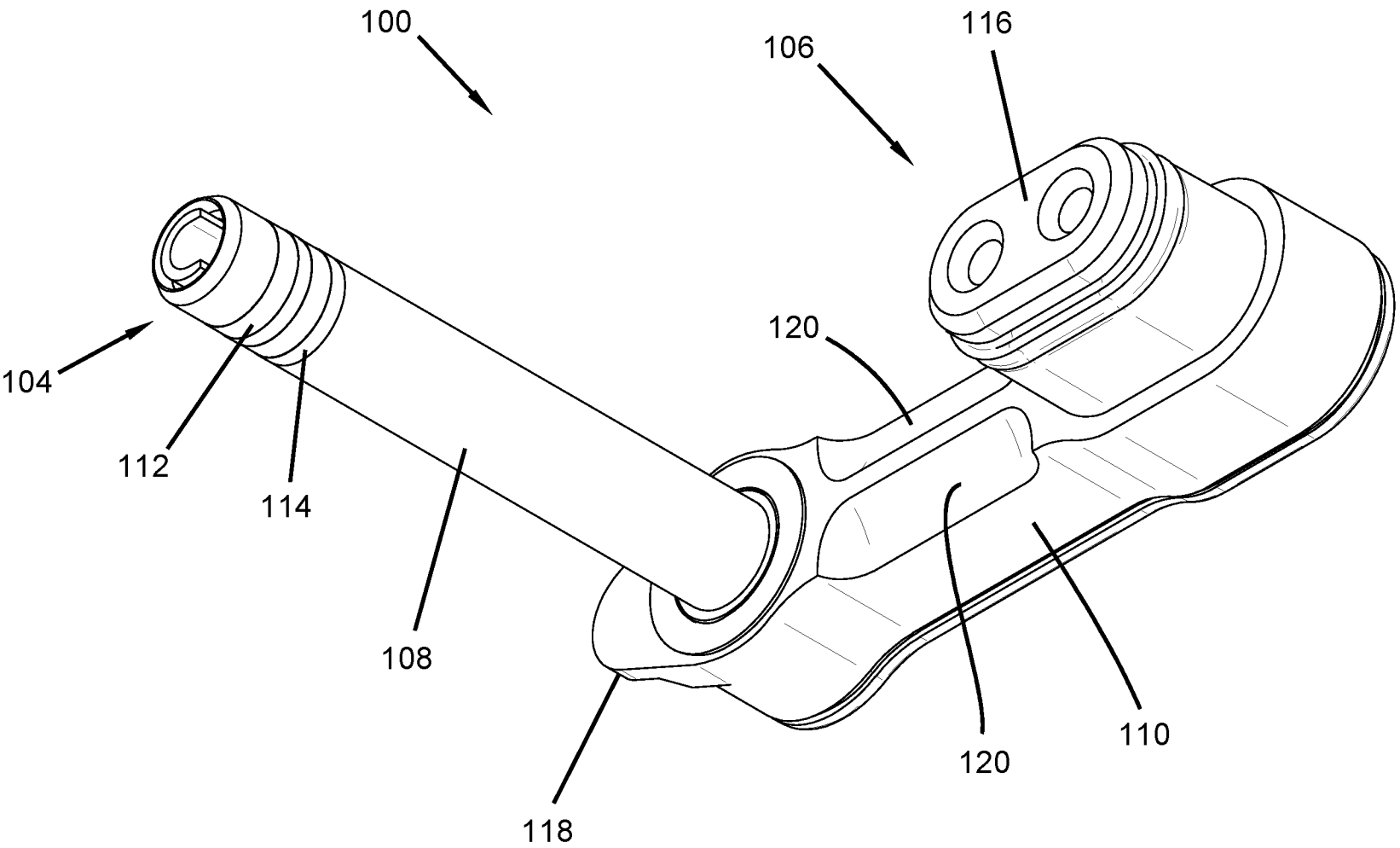
FIG. 14 is another isometric view of the pivot pin device.
Figure 15:
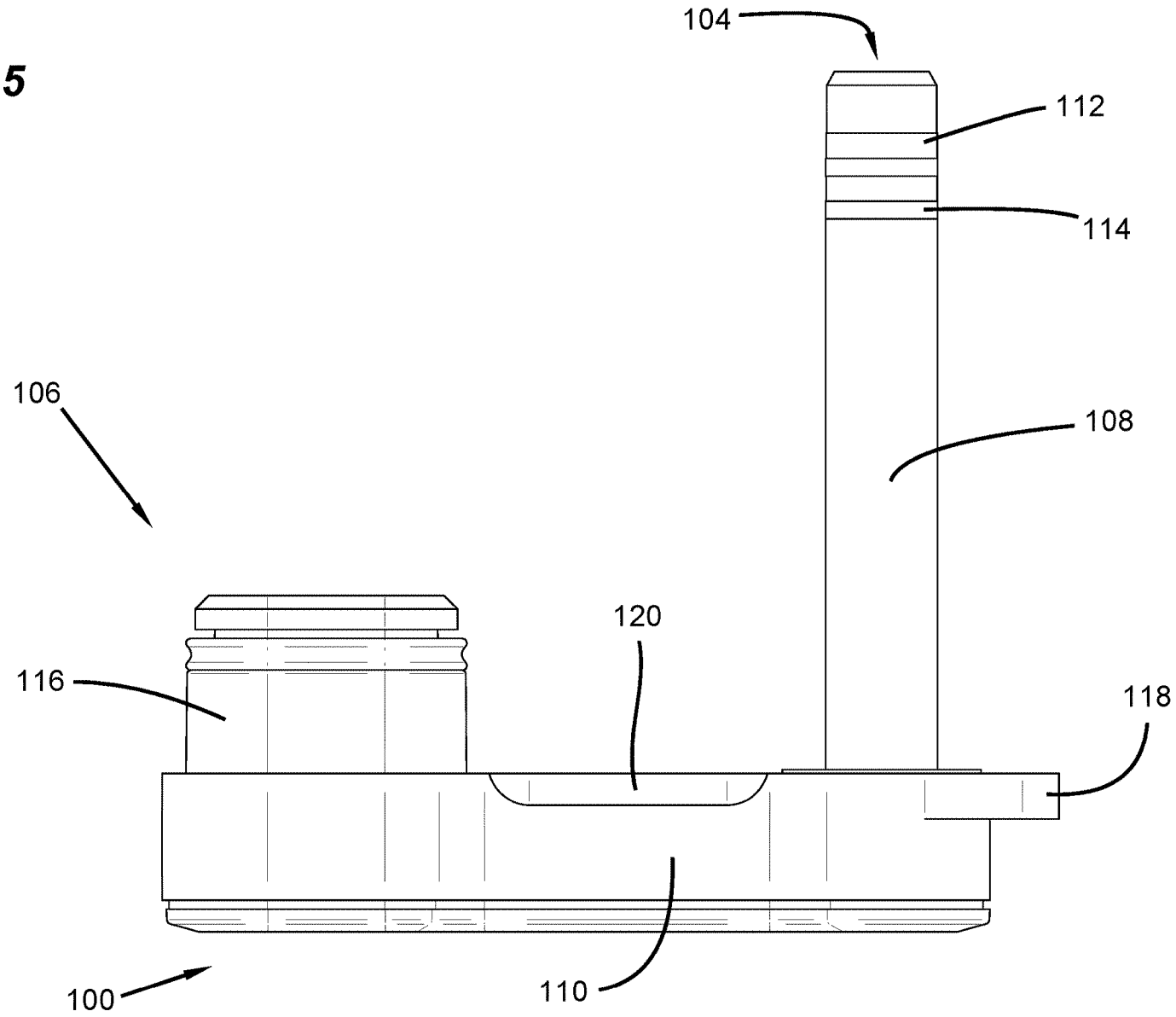
FIG. 15 is a top view of the pivot pin device.
Figure 16:
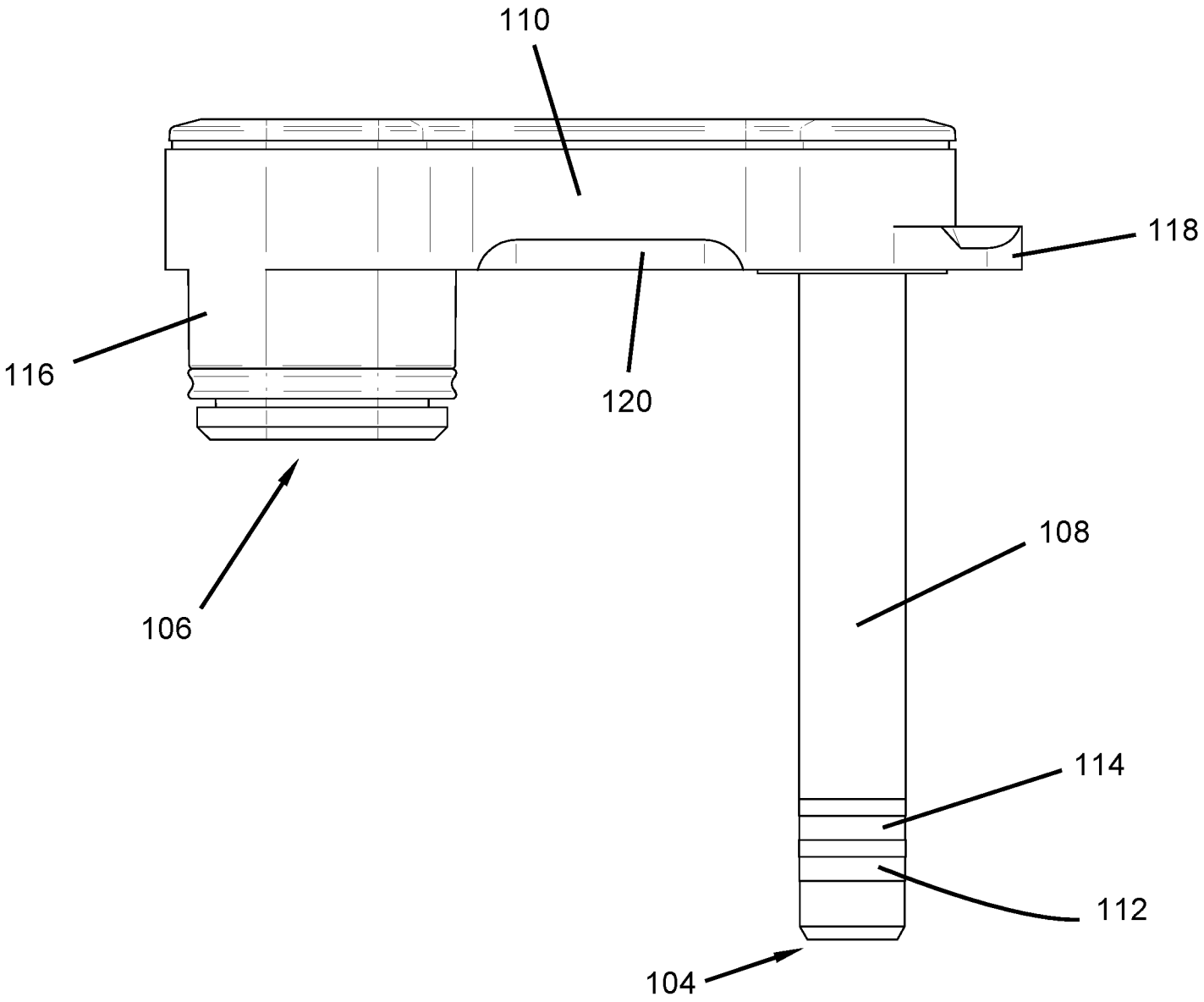
FIG. 16 is a bottom view of the pivot pin device.
Figure 17:
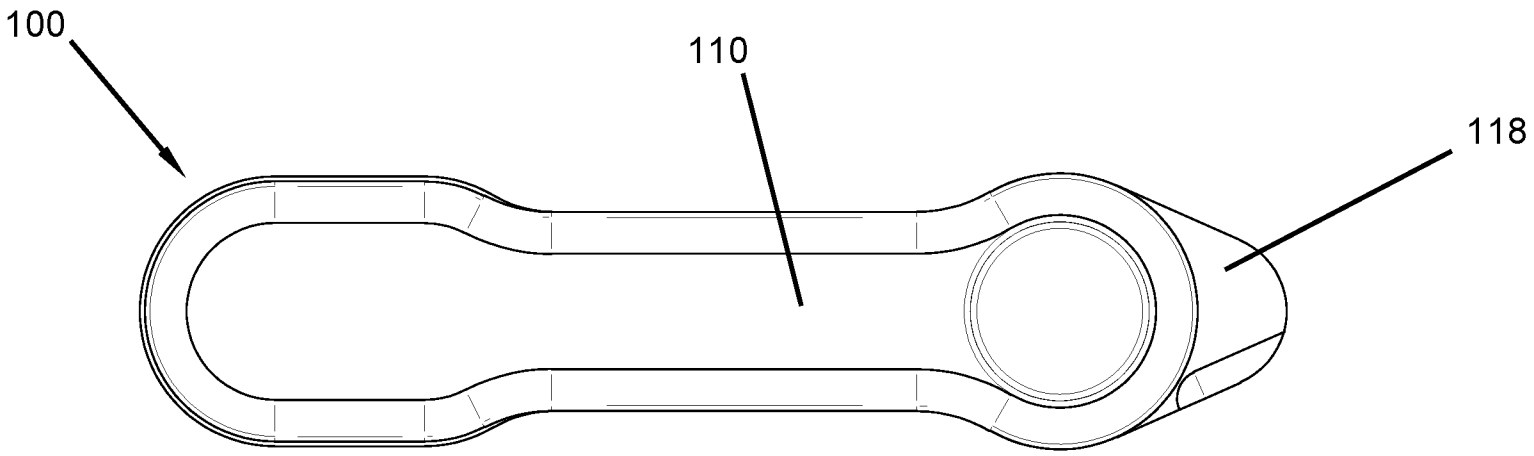
FIG. 17 is a side view of the pivot pin device.
Figure 18:
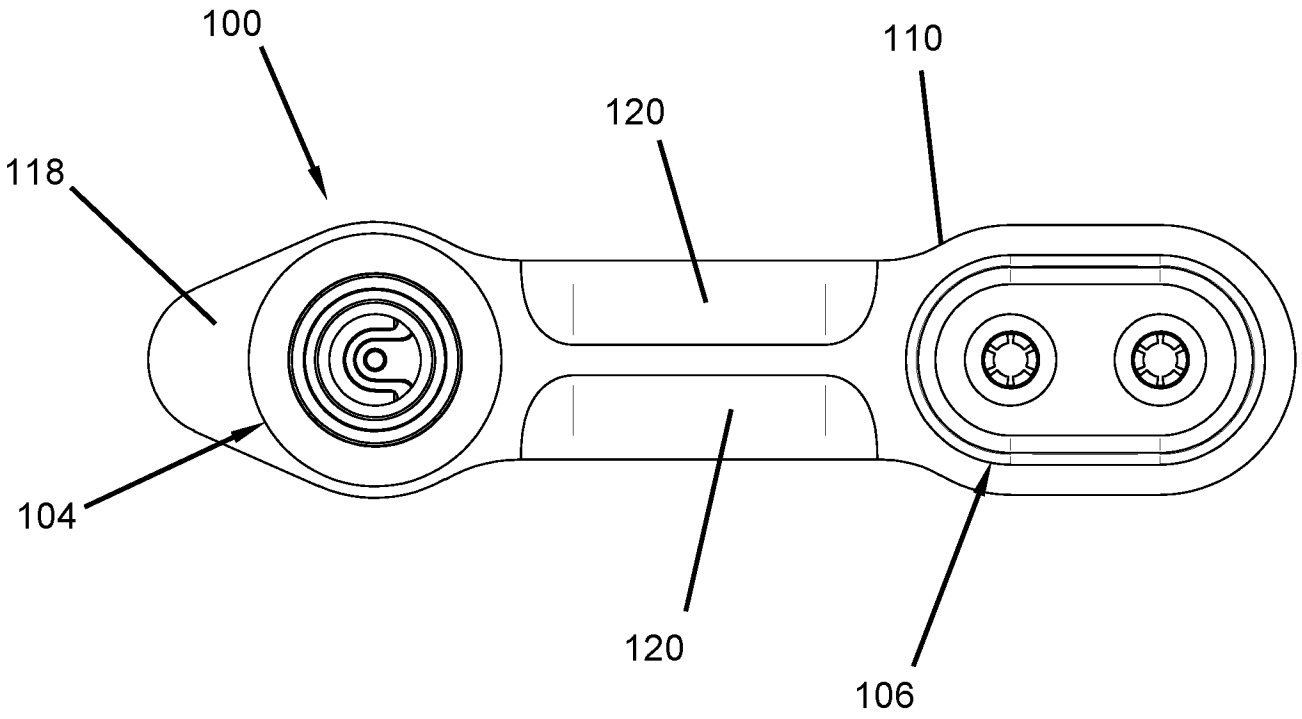
FIG. 18 is an opposite side view of the pivot pin device.
Figure 19:
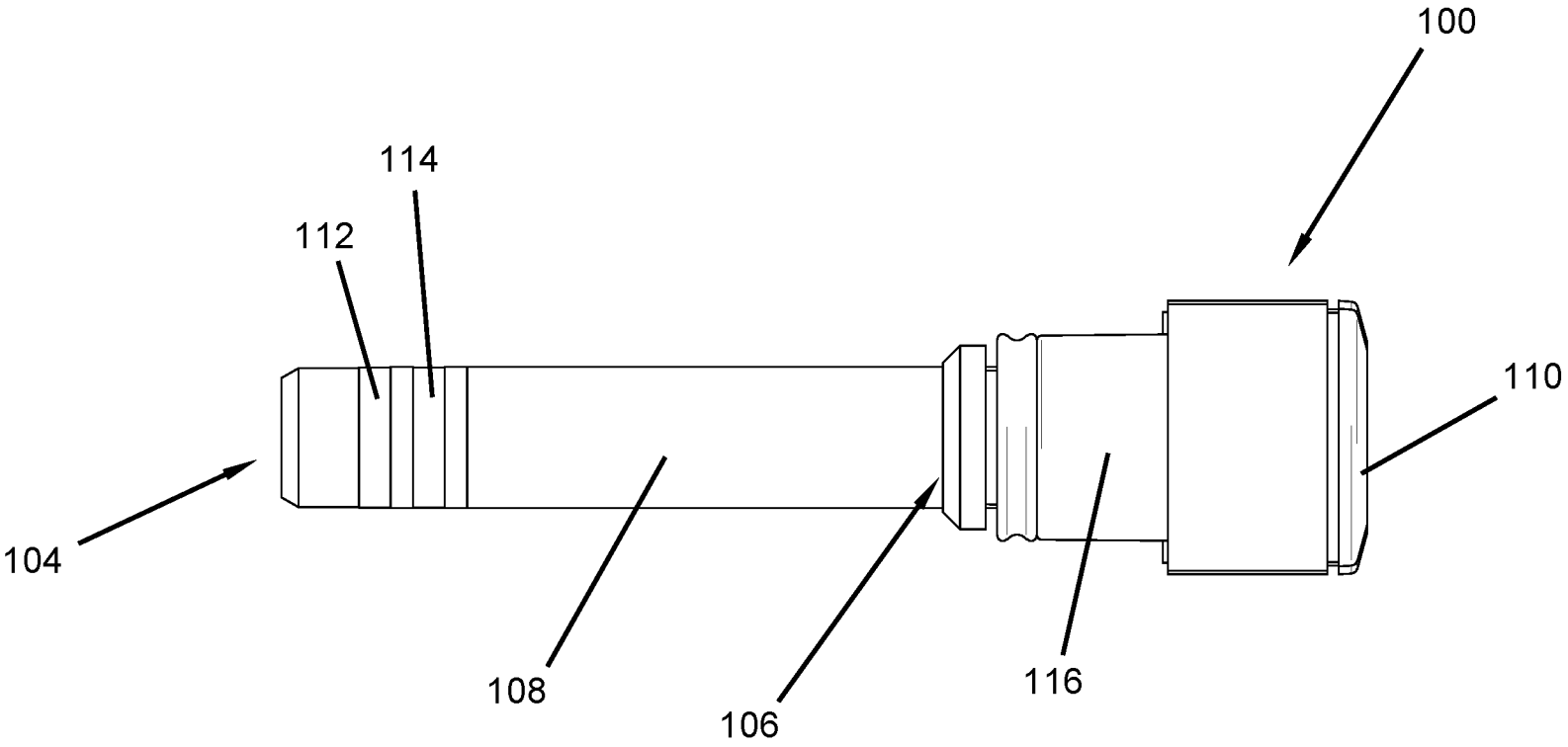
FIG. 19 is a front view of the pivot pin device.
Figure 20:
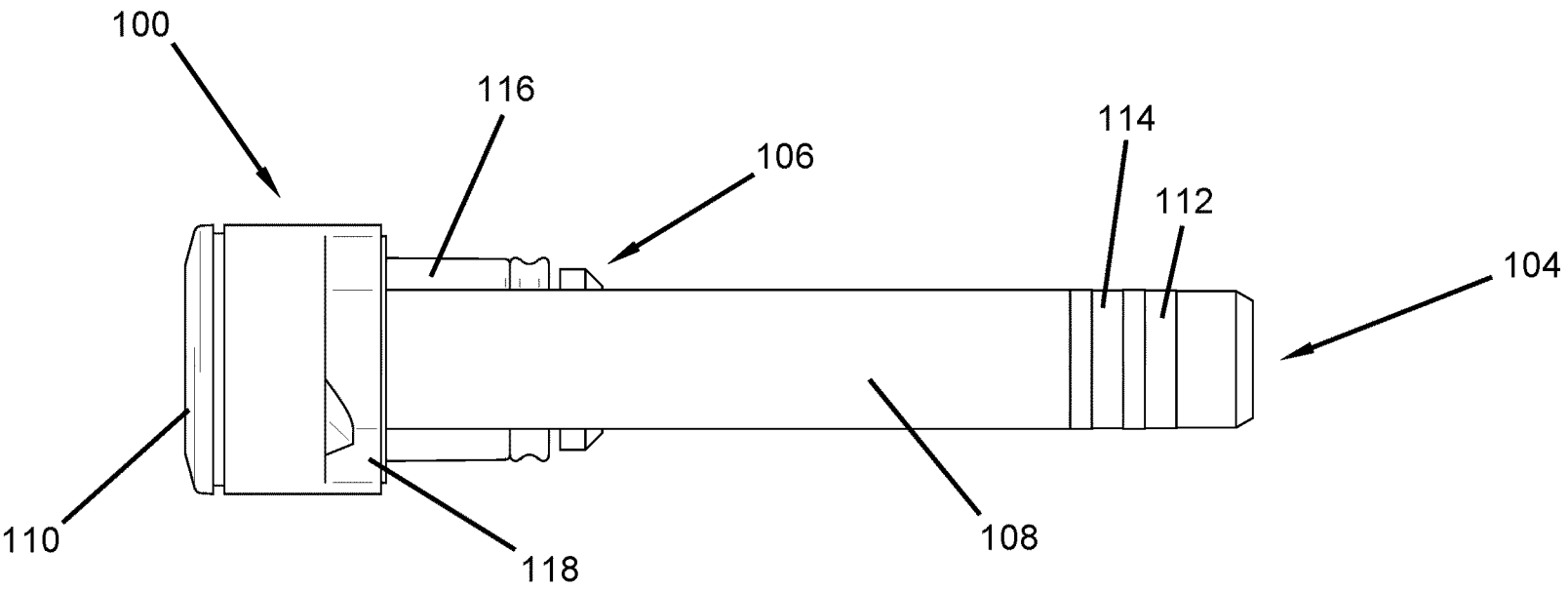
FIG. 20 is a rear view of the pivot pin device.

The conductive bus assembly 218 transfers the electrical power from the upper conductors 216 to the at least one accessory rail 204. FIG. 12 is a detailed view of the at least one accessory rail 204. As shown in FIG. 12, each accessory rail 204 includes a conductive strip 250 having electrical contacts 220 that are configured to engage contacts on an electronic accessory device to supply the electrical power from the electrical power source 202 to the electronic accessory device when the electronic accessory device is mounted to the firearm 10.

Each accessory rail 204 also includes grips 222 that enable each accessory rail 204 to be mechanically gripped by an electronic accessory device for attachment of the electronic accessory device to the firearm 10. In some examples, the grips 222 correspond to the structure of a Picatinny rail such that a variety of electronic accessory devices can be attached to the accessory rails 204 for mounting onto the firearm 10.

In the examples illustrated in the figures, the electrical system 200 includes four accessory rails 204 mounted around the handguard 18 of the firearm 10. Alternative configurations are contemplated such that fewer than four accessory rails 204 can be mounted to the firearm 10 or more than four accessory rails 204 can be mounted to the firearm 10. Also, the location where the accessory rails 204 are mounted on the upper receiver 12 may vary such that the accessory rails 204 can be mounted to different portions of the upper receiver 12 without mounting to the handguard 18 such as a top portion of the upper receiver 12.

As shown in FIGS. 3, 5, and 9, the electrical system 200 further includes a switch 230 that is connected between the upper conductors 216 and the at least one accessory rail 204. The switch 230 is configured to disconnect the electrical power supply from the electrical power source 202 to the at least one accessory rail 204. The switch 230 is rotatable between ON and OFF positions. The switch 230 acts as a master on/off switch such that when the switch 230 is rotated to the ON position, the electrical power flows from the electrical power source 202 to the accessory rails 204, and when the switch 230 is rotated to the OFF position, the electrical power flow between the electrical power source 202 and the accessory rails 204 is disconnected.

Advantageously, the switch 230 can be used to enforce light discipline during combat such that electronic accessory devices when mounted to the firearm 10 are not accidentally turned on during battle (if accidentally turned on, the electronic accessory devices can be seen by the enemy and give away the position of the user of the firearm 10). Another advantage of the switch 230 when turned off is that it can eliminate parasitic energy losses from the electronic accessory devices to preserver the battery life of the electrical power source 202.

As shown in FIGS. 1 and 8, a control module 240 can be connected to an accessory rail 204. The control module 240 includes one or more buttons that are configured to receive manual inputs from a user of the firearm 10 to control the operation of one or more electronic accessory devices when the control module 240 and electronic accessory devices are mounted to at least one accessory rail 204. The control module 240 can communicate with the one or more electronic accessory devices over the accessory rails 204 using Impressed Communications over DC power. Advantageously, the control module 240 enables a user of the firearm 10 to control multiple electronic accessory devices from a single, convenient location on the firearm 10.

In the examples illustrated in the figures, the control module 240 is at least partially secured to the handguard 18 by a mechanical fastener 242 (see FIG. 1) such as a screw. In some examples, as an alternative or in addition to using the mechanical fastener 242, the control module 240 can include a grip mechanism that engages the grips 222 of the accessory rail 204 to mechanically secure the control module 240 to the firearm 10.

FIGS. 13-20 illustrate isometric, top, bottom, side, front, and rear views of the pivot pin device 100. Referring now to FIGS. 13-20, the pivot pin device 100 includes a housing 102 that defines an interior cavity for routing electrical conductors from a first end 104 of the pivot pin device 100 to a second end 106 of the pivot pin device 100.

The housing 102 has a cylindrical portion 108 that terminates at the first end 104 and a lateral portion 110 that extends substantially orthogonal from the cylindrical portion 108 and that terminates at the second end 106. The housing 102 is substantially L-shaped such that the cylindrical portion 108 is configured to traverse between the first and second sides of the firearm 10 and the lateral portion 110 is configured to be substantially parallel to the first side of the firearm 10 when the pivot pin device 100 is inserted into the upper and lower receivers 12, 14.

The cylindrical portion 108 is configured to provide the mechanical pivot point between upper and lower receivers 12, 14 of the firearm 10. Additionally, the cylindrical portion 108 is configured to prevent detachment of the upper and lower receivers 12, 14 when the pivot pin device 100 is inserted through the upper and lower receivers 12, 14.

First and second electrical contacts 112, 114 are axially spaced apart from one another on the cylindrical portion 108 towards the first end 104. The first and second electrical contacts 112, 114 are each configured to engage corresponding first and second coil contacts 232, 234 inside the receptacle 210 (see FIG. 23). The first and second electrical contacts 112, 114 receive the electrical power in the receptacle 210 by contacting the first and second coil contacts 232, 234.

A plug portion 116 positioned at the second end 106 is configured for insertion inside the ruggedized connector port 214 in the upper receiver 12 to mate the electrical conductors inside the pivot pin device 100 with the corresponding upper conductors 216 inside the ruggedized connector port 214 for transferring the electrical power from the electrical power source 202 in the lower receiver 14 to the accessory rails 204 in the upper receiver 12.

The lobe 118 (described above with reference to FIGS. 3 and 5) extends from the lateral portion 110 opposite the plug portion 116. As described above, the lobe 118 is configured to engage the tab 56 on the lower receiver 14 when the upper and lower receivers 12, 14 are in the closed position to prevent removal of the pivot pin device 100 from the firearm 10, and is configured to disengage the tab 56 when the upper and lower receivers 12, 14 are in the open position to allow removal of the pivot pin device 100 from the firearm 10.

As shown in FIGS. 13-20, the lateral portion 110 includes grips 120 that are configured to receive the fingertips of a user of the firearm 10 to help facilitate the user to grip the lateral portion 110 to pull the pivot pin device 100 out of the firearm 10. In the example illustrated in the figures, the grips 120 are molded on an interior surface of the lateral portion 110.

Figure 21:
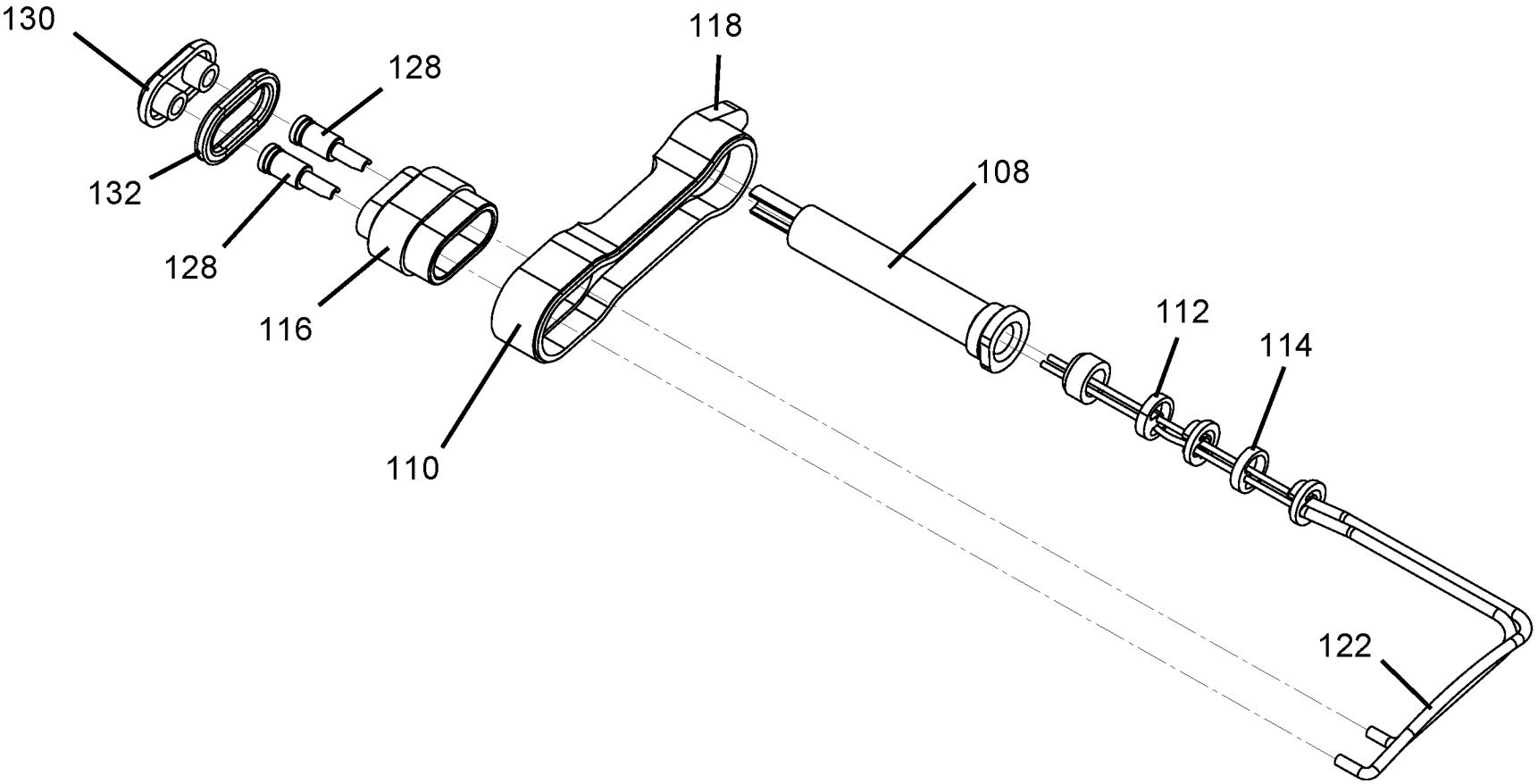
FIG. 21 is an exploded isometric view of the pivot pin device.
Figure 22:
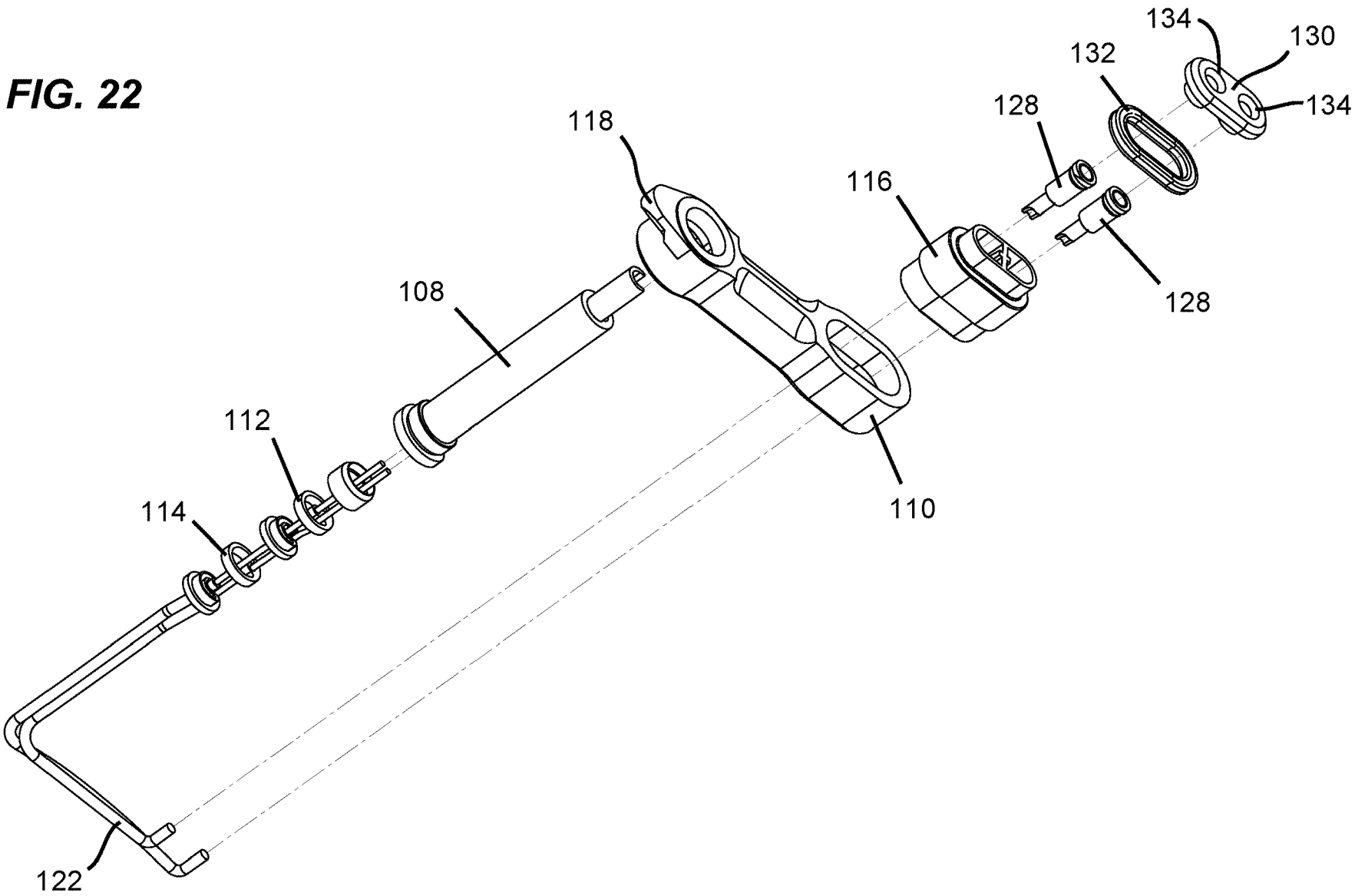
FIG. 22 is another exploded isometric view of the pivot pin device.

FIGS. 21 and 22 are exploded isometric views of the pivot pin device 100. Referring now to FIGS. 21 and 22, the pivot pin device 100 includes the electrical conductors 122 that are routed from the first end 104 to the second end 106 of the pivot pin device 100. The first and second electrical contacts 112, 114 each have an exterior portion configured to engage a respective coil contact 232, 234 inside the receptacle 210 (see FIG. 23), and each have an interior portion that engages a respective electrical conductor 122. As shown in FIGS. 21 and 22, the exterior portion of each electrical contact 112, 114 is substantially circular. The interior portion extends from the exterior portion towards a center of each electrical contact 112, 114 and includes a bore to engage and wrap around an electrical conductor 122.

As further shown in FIGS. 21 and 22, the plug portion 116 includes receptacles 128 that extend toward a faceplate 130. The faceplate 130 defines openings 134 that are configured to receive conductors 244, 246 inside the ruggedized connector port 214 (see FIGS. 10 and 24). The receptacles 128 are configured to mate the electrical conductors 122 inside the pivot pin device 100 with the upper conductors 216 inside the ruggedized connector port 214 (see FIG. 24).

A gasket 132 surrounds the plug portion 116 to provide an environmental seal between the plug portion 116 and the ruggedized connector port 214. For example, the gasket 132 can engage a housing 215 (see FIG. 6) of the ruggedized connector port 214 to provide the environmental seal between the plug portion 116 and the ruggedized connector port 214. The environmental seal prevents debris such as dirt, corrosion, water, humidity from penetrating the connection between the plug portion 116 and the ruggedized connector port 214.

Figure 23:
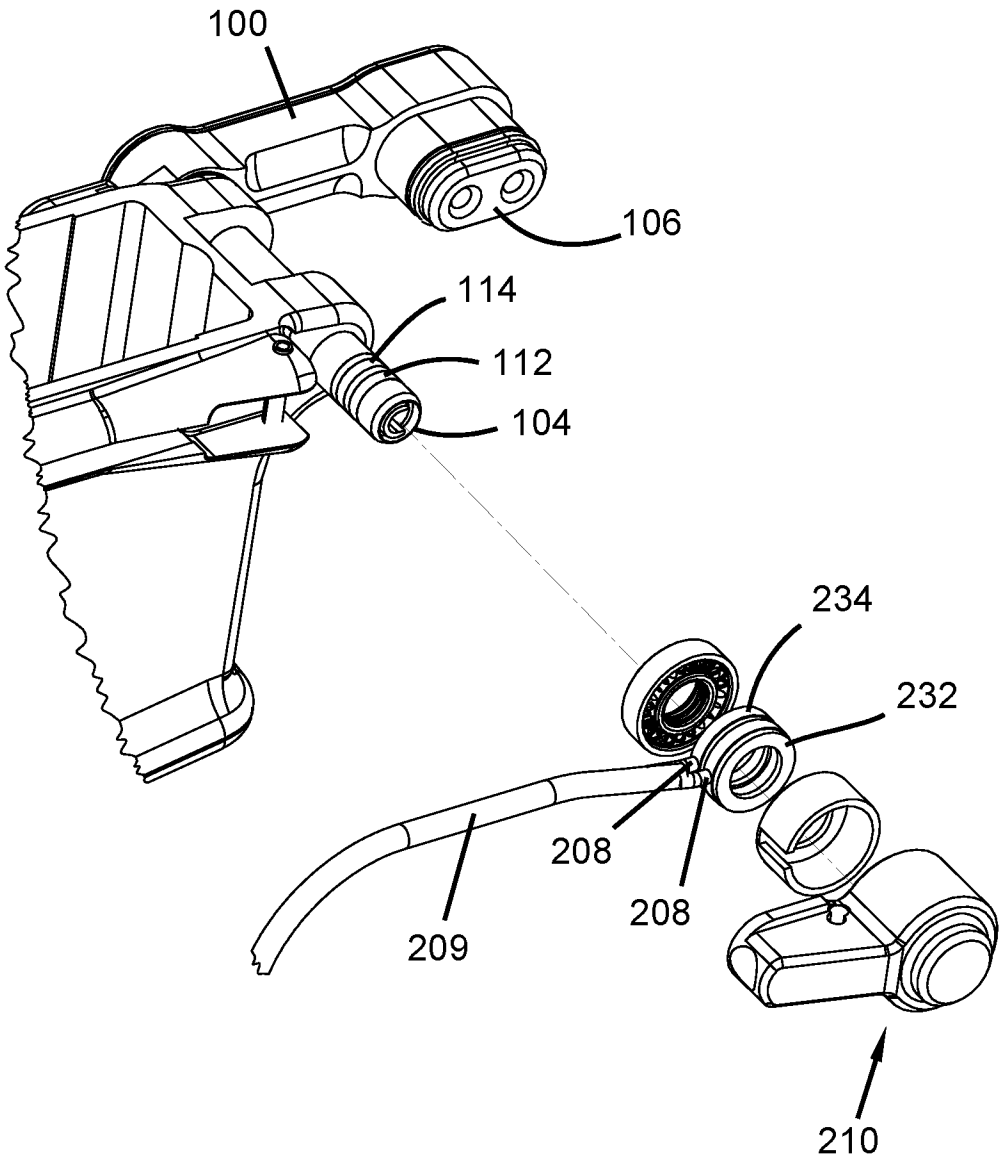
FIG. 23 is an exploded view of a receptacle in the lower receiver.

FIG. 23 is an exploded view of the receptacle 210. As shown in FIG. 23, the lower conductors 208 inside the cable jacket 209 are connected to the first and second coil contacts 232, 234 inside the receptacle 210. When the first end 104 of the pivot pin device 100 is inserted into the receptacle 210, the first and second electrical contacts 112, 114 engage the first and second coil contacts 232, 234 to draw the electrical power from the lower conductors 208 to the electrical conductors 122 (see FIGS. 21 and 2) housed inside the pivot pin device 100.

Figure 24:
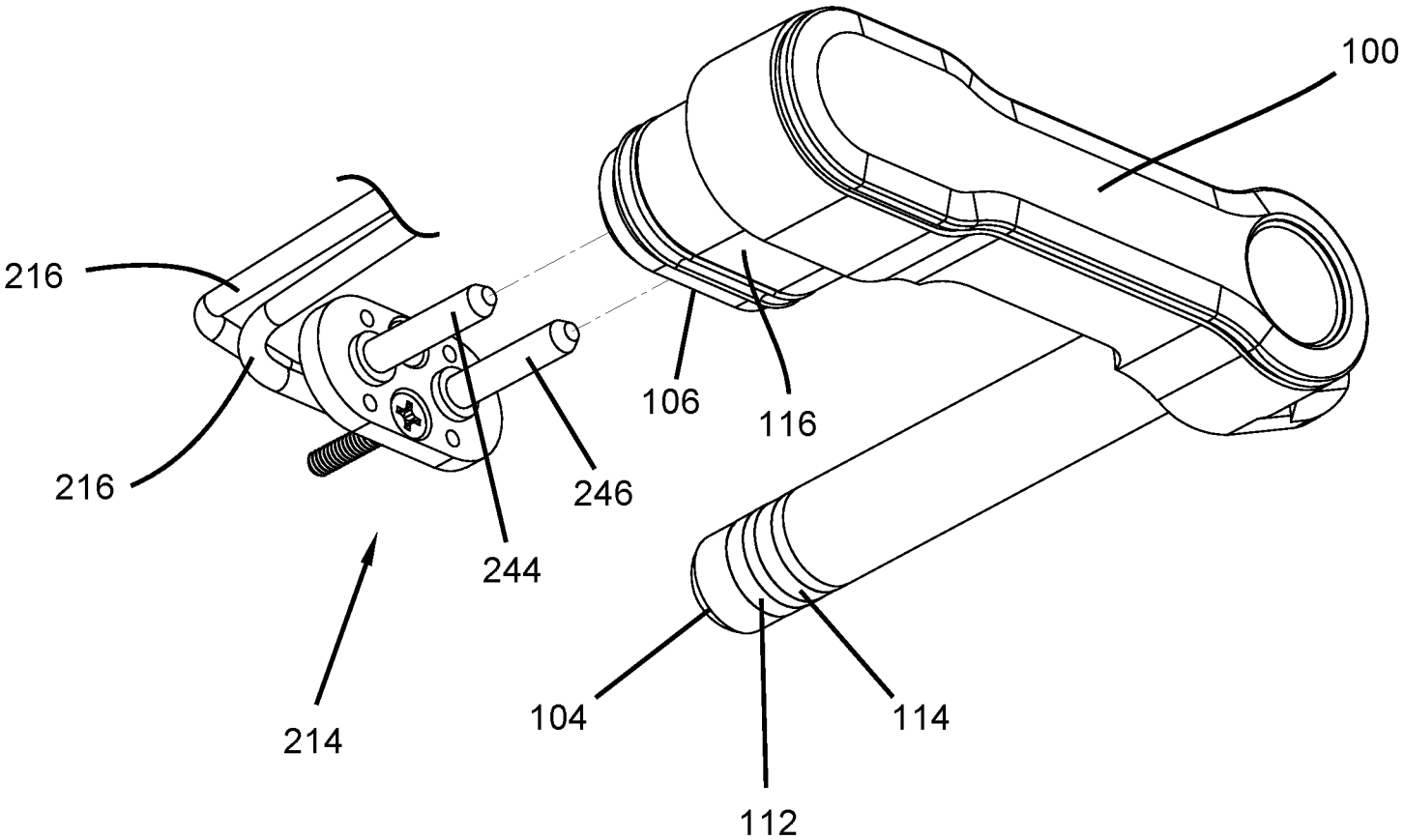
FIG. 24 is a detailed isometric view of a ruggedized connector port.

FIG. 24 is an exploded view of the ruggedized connector port 214. As shown in FIG. 24, the ruggedized connector port 214 includes the conductors 244, 246 that are received by the plug portion 116 of the pivot pin device 100. The conductors 244, 246 are connected to the upper conductors 216 to transfer the electrical power from the pivot pin device 100 to the upper conductors 216, and hence transfer the electrical power to the at least one accessory rail 204 on the upper receiver 12 via the conductive bus assembly 218 (as shown in FIG. 9).

Figure 25:
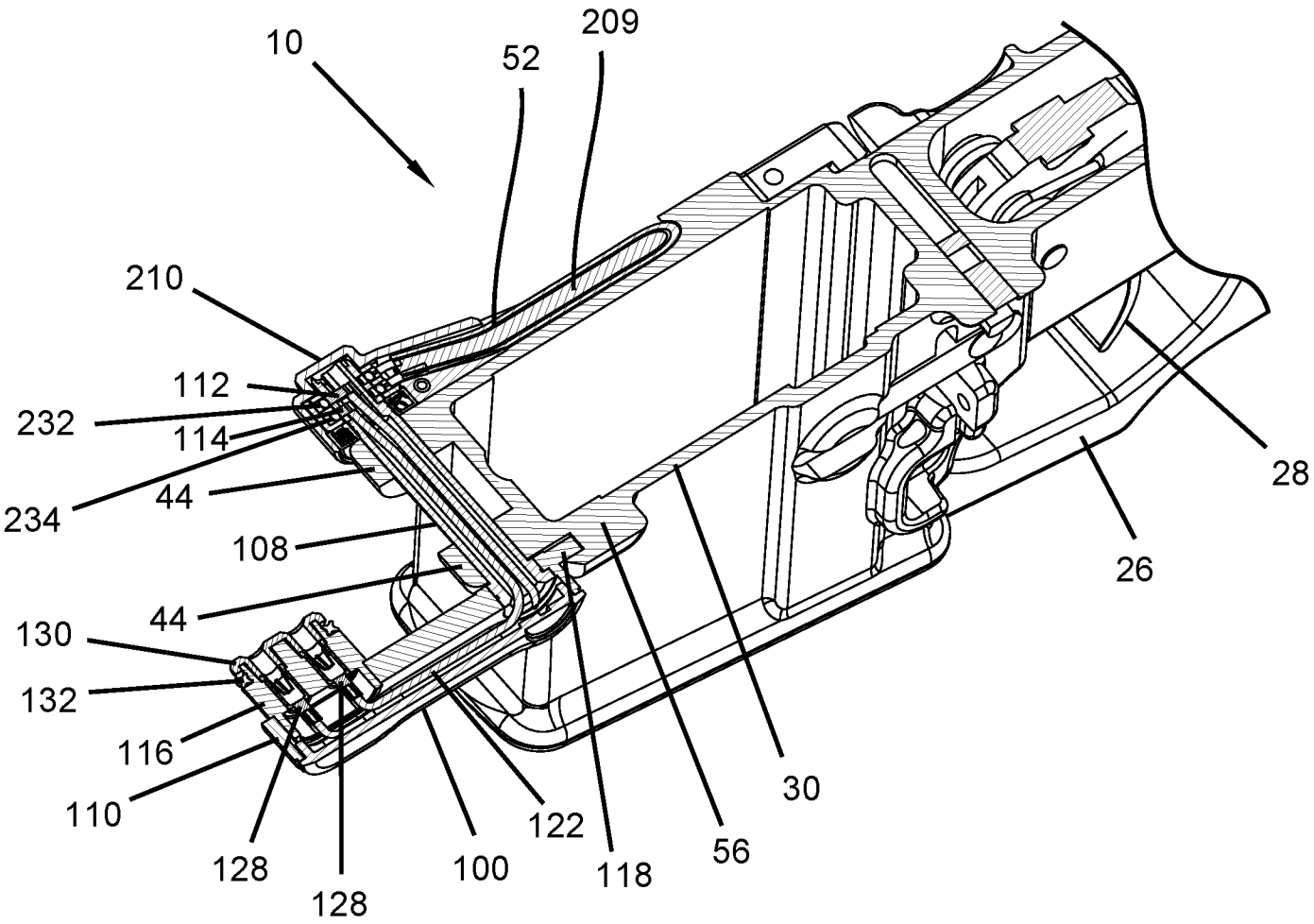
FIG. 25 is a partial cross-sectional view of the lower receiver with the pivot pin device inserted therein.

FIG. 25 is a cross-sectional view of the lower receiver 14 with the pivot pin device 100 inserted therein. In FIG. 25, the firearm is in the closed position such that the tab 56 engages the lobe 118 to block the pivot pin device 100 from being pulled out of the lower receiver 14. As further shown in FIG. 25, the cylindrical portion 108 of the pivot pin device 100 is inserted through the hinges 44 such that the cylindrical portion 108 can act as a mechanical pivot point between the lower receiver 14 and the upper receiver 12.

Still referring to FIG. 25, the first end 104 of the pivot pin device 100 is inserted into the receptacle 210 such that the first and second electrical contacts 112, 114 of the pivot pin device 100 engage the first and second coil contacts 232, 234 in the receptacle 210 to draw the electrical power from the lower conductors 208 inside the cable jacket 209 to the electrical conductors 122 inside the pivot pin device 100. In view of FIGS. 23-25, the pivot pin device 100 is an electrical bridge between the receptacle 210 in the lower receiver 14 and the ruggedized connector port 214 in the upper receiver 12 that transfers the electrical power from the lower conductors 208 in the lower receiver 14 to the upper conductors 216 in the upper receiver 12.

Figure 26:
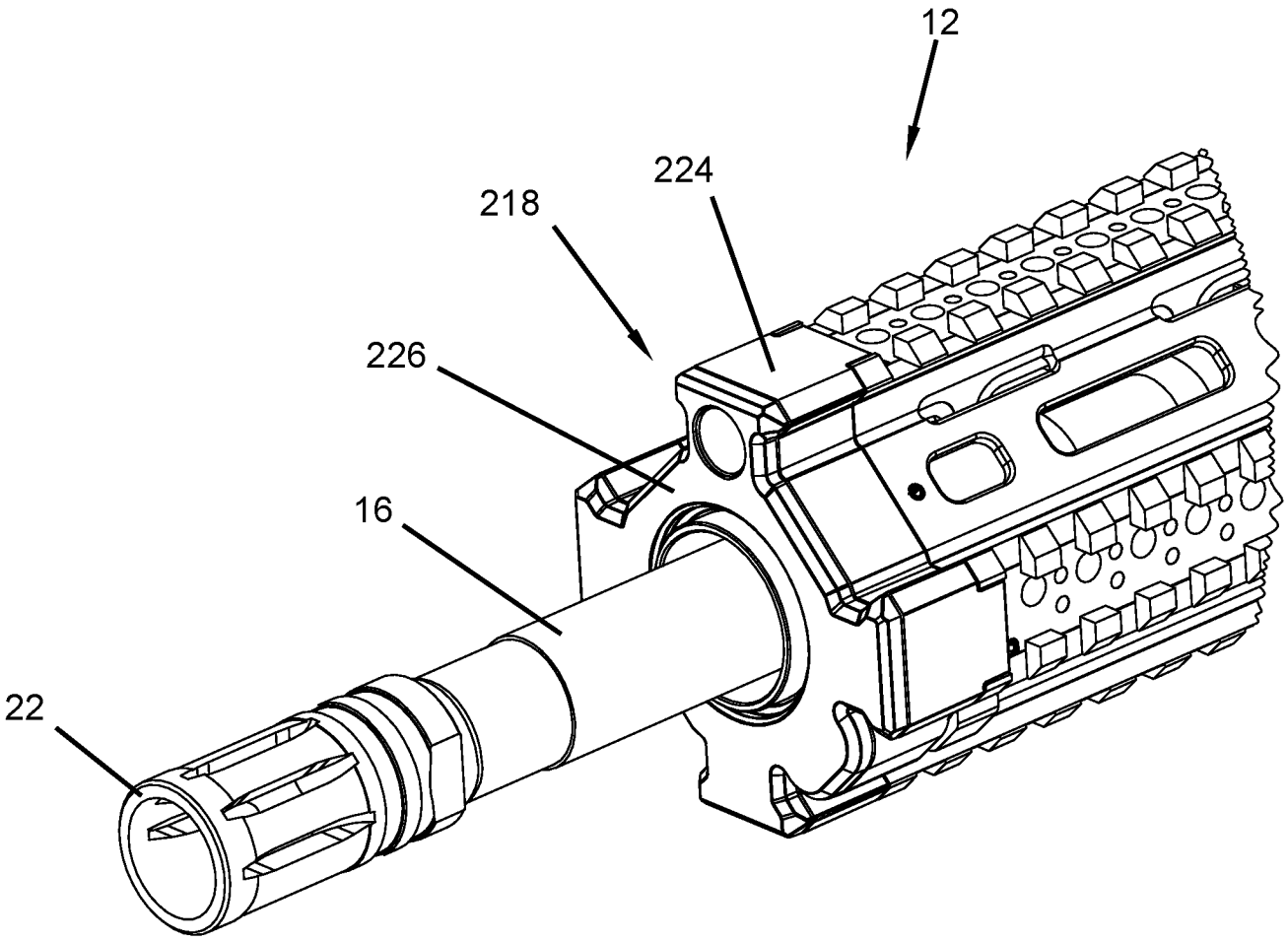
FIG. 26 is a detailed isometric view of a conductive bus assembly on the upper receiver.
Figure 27:
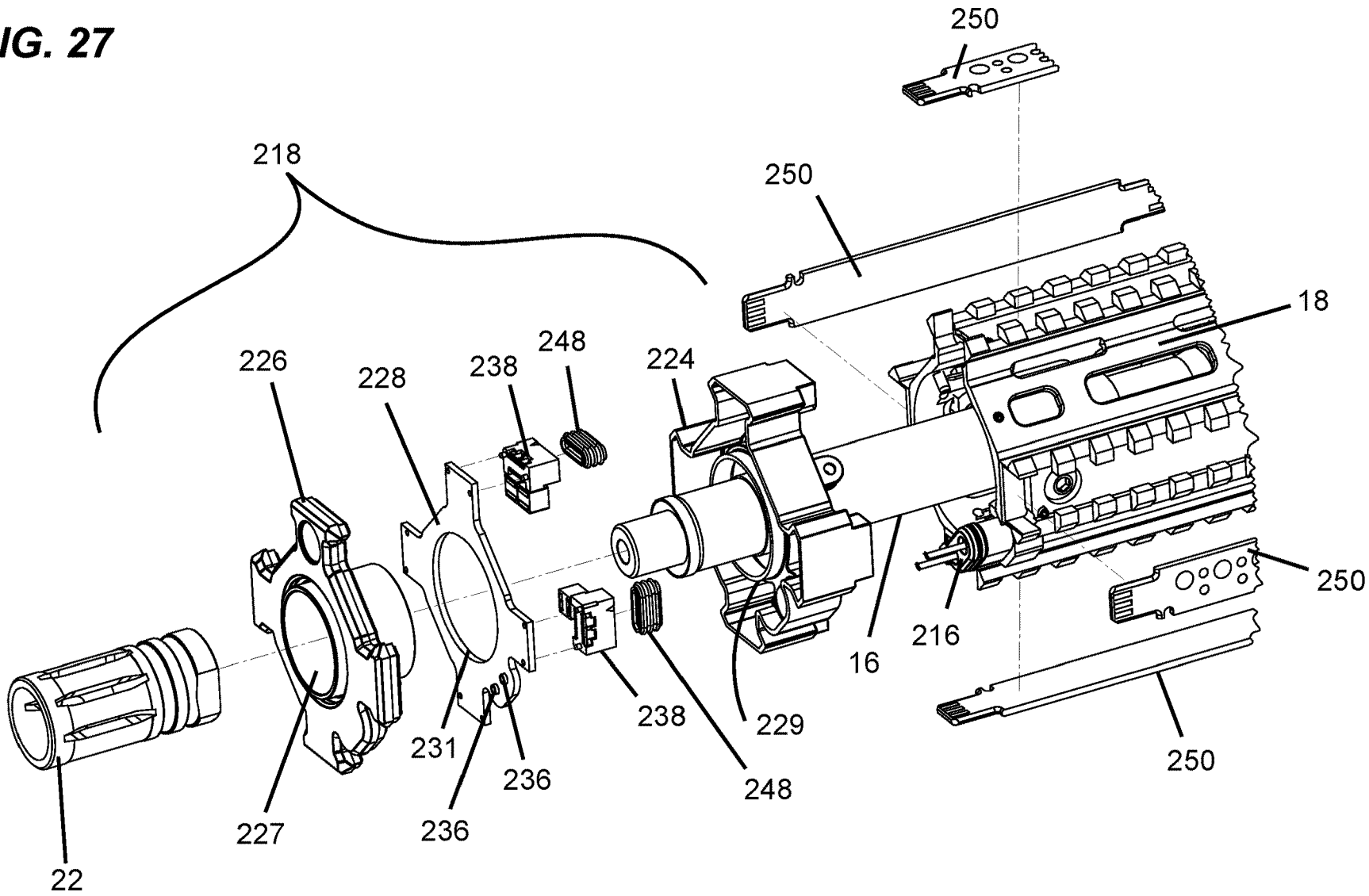
FIG. 27 is an exploded isometric view of the conductive bus assembly.

FIG. 26 is a detailed isometric view of a conductive bus assembly 218 on the upper receiver 12. FIG. 27 is an exploded isometric view of the conductive bus assembly 218. Referring now to FIGS. 26 and 27, the conductive bus assembly 218 includes a housing 224 that defines an interior space. A faceplate 226 attaches to one end of the housing 224 for sealing the interior space. The housing 224 and faceplate 226 each have apertures 227, 229 that enable the conductive bus assembly 218 to be installed around the barrel 16 of the firearm 10.

As shown in FIG. 27, the conductive bus assembly 218 includes a conductive bus 228 housed inside the interior space of the housing 224. The conductive bus 228 has an aperture 231 that enables the conductive bus 228 to be housed inside the housing 224 and around the barrel 16 of the firearm 10. The conductive bus 228 includes contacts 236 that engage the upper conductors 216 to transfer the electrical power from the upper conductors 216 onto the conductive bus 228, and around the barrel 16 on the upper receiver 12.

The conductive bus assembly 218 has receptacles 238 electrically connected around the conductive bus 228. The receptacles 238 receive ends of conductive strips 250 to transfer the electrical power from the conductive bus 228 onto the conductive strips 250. The conductive strips 250 are mounted to the accessory rails 204 (see also FIG. 12).

In some examples, the conductive bus assembly 218 includes four receptacles 238 such that four conductive strips 250 can be mounted around the barrel 16. It is contemplated that the number of receptacles 238 mounted to the conductive bus 228 can vary such that fewer than four conductive strips 250 can be mounted to the firearm 10 or more than four conductive strips 250 can be mounted to the firearm 10. In some examples, the receptacle 238 are female connectors while the ends of the conductive strips 250 are male connectors. In some examples, the conductive bus assembly 218 daisy chains a plurality of conductive strips 250 together such that each conductive strip 250 powers a plurality of electronic accessory devices.

The conductive bus assembly 218 further includes sealing glands 248 that seal the electrical connection between the receptacles 238 and the ends of the conductive strips 250. In some examples, the sealing glands 248 are made from a soft rubber material. The sealing glands 248 protect the electrical connection between the conductive bus assembly 218 and the conductive strips 250 from outside elements such as water, humidity, dirt, and the like. Advantageously, the sealing glands 248 ensure a steady supply of electrical power to the conductive strips 250 such that the electrical power to one or more electronic accessory devices mounted onto the accessory rails 204 is not interrupted.

Figure 28:
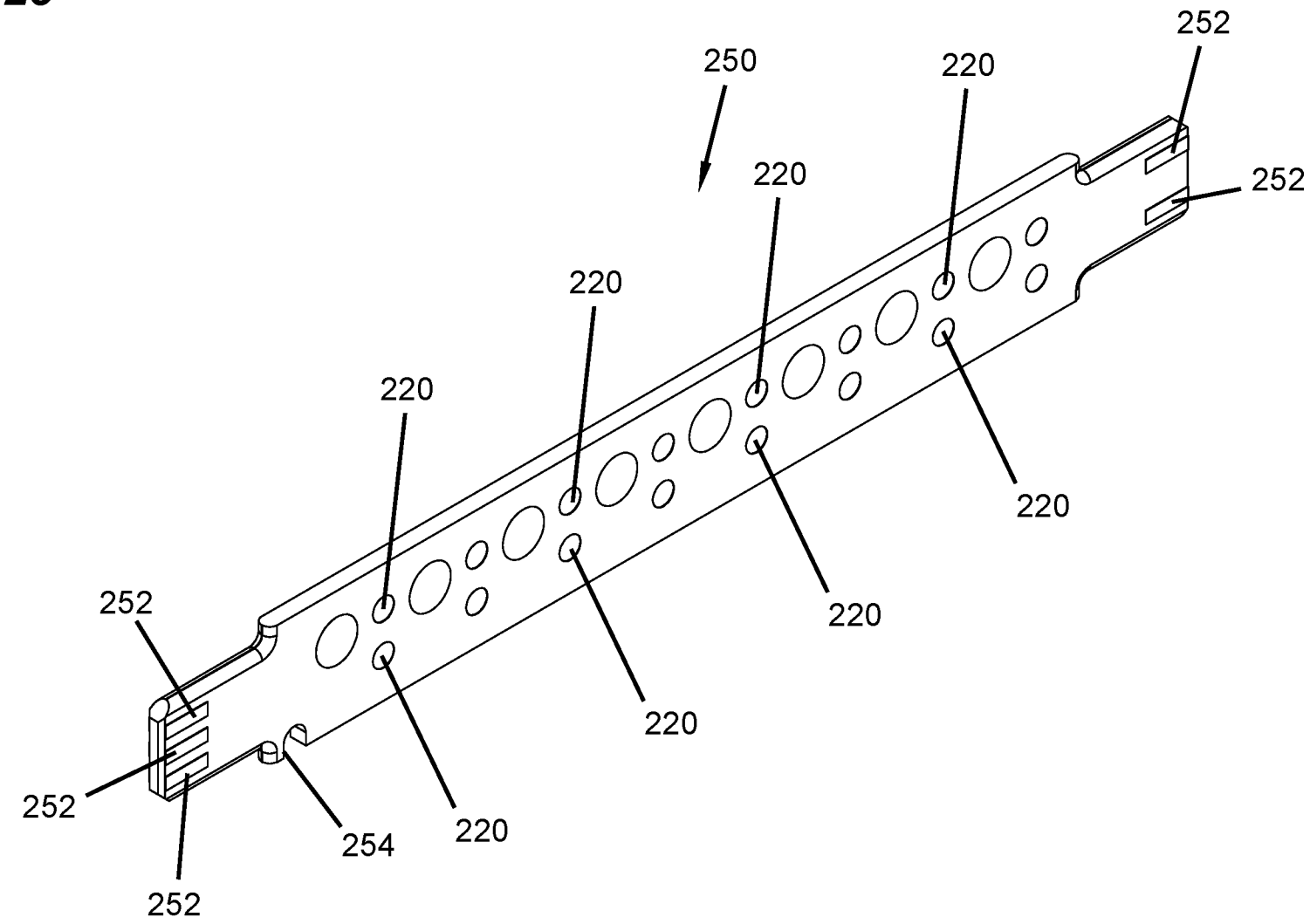
FIG. 28 is an isometric view of a conductive strip.

FIG. 28 is an isometric view of a conductive strip 250 that can be mounted to each accessory rail 204. The conductive strip 250 includes a plurality of electrical contacts 220 that are configured to engage corresponding contacts on an electronic accessory device to supply the electrical power from the electrical power source 202 to an electronic accessory device when the electronic accessory device is mounted to the firearm 10. The distal ends of the conductive strip 250 each include one or more contact pads 252 such that one distal end can be inserted into a receptacle 238 of the conductive bus assembly 218 for transferring the electrical power to the conductive strip 250 while an opposite distal end of the conductive strip 250 can be plugged into a receptacle of another device such as the control module 240, as shown in FIG. 8. In some examples, the conductive strip 250 includes a slot 254 that provides a reference point to ensure correct orientation of the conductive strip 250 on the accessory rail 204, such as when the conductive strip 250 is being installed onto the accessory rail 204 as a modular component.

Advantageously, the conductive bus assembly 218 including the conductive strips 250 are a modular system that can be added onto a standard firearm with little or no modification of the original components of the firearm. For example, the housing 224 of the conductive bus assembly 218 can be mounted around the handguard of the firearm, while the conductive strips 250 can be added to the accessory rails of the firearm (e.g., Picatinny rails) without substantial modifications to the handguard and accessory rails, respectively. Accordingly, in some examples, the conductive bus assembly 218 is a power coupling for use on an accessory rail. Additionally, the receptacles 238 and sealing glands 248 allow accessory rails equipped with the conductive strips 250 to be simply plugged into the conductive bus assembly 218, and thus simplify the assembly of the electrical system 200 onto the firearm 10.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A pivot pin device for a firearm, the pivot pin device comprising:

a housing defining an interior cavity for routing electrical conductors from a first end of the pivot pin device to a second end of the pivot pin device, the housing including:

a cylindrical portion terminating at the first end and being configured to provide a mechanical pivot point between upper and lower receivers of a firearm; and a lateral portion extending substantially orthogonal from the cylindrical portion and terminating at the second end;

electrical contacts positioned at the first end, the electrical contacts axially spaced apart from one another and each having an exterior portion configured to engage a respective coil contact inside a receptacle in the lower receiver, and each having an interior portion engaging a respective electrical conductor; and a plug portion positioned at the second end, the plug portion being configured for insertion inside a connector port in the upper receiver to mate the electrical conductors with corresponding electrical conductors inside the connector port for transferring electrical power from the lower receiver to the upper receiver.

2. The pivot pin device of claim 1, wherein the mechanical pivot point enables the upper and lower receivers to pivot with respect to one another from a closed position to an open position and from the open position to the closed position.

3. The pivot pin device of claim 2, further comprising a lobe extending from the lateral portion opposite the plug portion, the lobe being configured to engage a tab on the lower receiver to prevent removal of the pivot pin device from the firearm when the upper and lower receivers are in the closed position, and to allow removal of the pivot pin device from the firearm when the upper and lower receivers are in the open position.

4. The pivot pin device of claim 2, wherein the pivot pin device maintains a supply of the electrical power from the receptacle in the lower receiver to the connector port in the upper receiver when the upper and lower receivers pivot from the closed position to the open position and from the open position to the closed position.

5. The pivot pin device of claim 1, wherein the cylindrical portion prevents detachment of the upper and lower receivers when inserted through the upper and lower receivers.

6. The pivot pin device of claim 1, wherein the electrical power is a direct current voltage.

7. The pivot pin device of claim 1, wherein the housing is substantially L-shaped such that the cylindrical portion is configured to traverse between a first side and a second side of the firearm and the lateral portion is configured to be substantially parallel to the second side of the firearm when the pivot pin device is inserted through the upper and lower receivers.

8. The pivot pin device of claim 1, wherein the lateral portion includes grips shaped for fingertips to grip and pull the pivot pin device out of the firearm.

9. The pivot pin device of claim 8, wherein the grips are molded on an interior surface of the lateral portion.

10. The pivot pin device of claim 1, wherein the plug portion includes a faceplate that defines openings configured to receive the corresponding electrical conductors of the connector port, and the plug portion includes receptacles configured to mate the electrical conductors inside the pivot pin device with the corresponding electrical conductors of the connector port.

11. The pivot pin device of claim 1, further comprising a gasket that surrounds the plug portion to provide an environmental seal between the plug portion and the connector port.

12. A pivot pin device for a firearm, the pivot pin device comprising:

a housing having a cylindrical portion that provides a mechanical pivot point between upper and lower receivers of the firearm;

one or more electrical contacts on the cylindrical portion configured to draw electrical power from a receptacle mounted on the lower receiver; and a plug portion terminating one or more electrical conductors inside the housing, the one or more electrical conductors configured to transfer the electrical power from the receptacle mounted on the lower receiver to a connector port mounted on the upper receiver.

13. The pivot pin device of claim 12, further comprising:

a lateral portion connecting the plug portion to the cylindrical portion, the lateral portion extending orthogonally between the cylindrical portion and the plug portion.

14. The pivot pin device of claim 13, wherein the lateral portion includes grips shaped for fingertips to grip and pull the pivot pin device out of the firearm.

15. The pivot pin device of claim 14, wherein cylindrical portion defines a first end, the plug portion defines a second end, and the first and second ends face in the same direction.

16. The pivot pin device of claim 12, further comprising:

two or more electrical contacts on the cylindrical portion, the two or more contacts are axially spaced apart from one another along a length of the cylindrical portion.

17. The pivot pin device of claim 16, wherein each electrical contact has an exterior portion configured to engage a respective coil contact inside the receptacle mounted on the lower receiver, and wherein each electrical contact has an interior portion engaging a respective electrical conductor inside the housing of the pivot pin device.

18. The pivot pin device of claim 12, wherein the plug portion includes a faceplate that defines openings configured to receive one or more electrical conductors from the connector port.

19. The pivot pin device of claim 18, wherein the plug portion further includes receptacles configured to mate the one or more electrical conductors inside the housing with the one or more electrical conductors from the connector port.

20. The pivot pin device of claim 12, further comprising a gasket that surrounds the plug portion to provide an environmental seal between the plug portion and the connector port.

* * * * *